US012692778B2

(12) United States Patent
Zhong et al.

(10) Patent No.: US 12,692,778 B2
(45) Date of Patent: Jul. 28, 2026

(54) ANTICORRELATION IN PROPAGATION RESISTIVITY LOGS FOR GEOSTEERING

(71) Applicant: Schlumberger Technology Corporation, Sugar Land, TX (US)

(72) Inventors: Xiaoyan Zhong, Sugar Land, TX (US); Yong Chang, Sugar Land, TX (US); Sepand Ossia, Sugar Land, TX (US); Shunfeng Zheng, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 119 days.

(21) Appl. No.: 18/889,636

(22) Filed: Sep. 19, 2024

(65) Prior Publication Data

US 2025/0327394 A1 Oct. 23, 2025

Related U.S. Application Data

(60) Provisional application No. 63/635,247, filed on Apr. 17, 2024.

(51) Int. Cl.

| | |
|---|---|
| ***E21B 44/00*** | (2006.01) |
| ***E21B 7/06*** | (2006.01) |
| ***E21B 47/026*** | (2006.01) |

(52) U.S. Cl.

CPC ..... *E21B 44/00* (2013.01); *E21B 7/06* (2013.01); *E21B 47/026* (2013.01)

(58) Field of Classification Search

CPC ..... E21B 44/00; E21B 7/06; E21B 47/026

See application file for complete search history.

(56) References Cited

U.S. PATENT DOCUMENTS

| | | | |
|---|---|---|---|
| 5,867,806 | A | 2/1999 | Strickland et al. |
| 6,631,328 | B2 | 10/2003 | Haugland |
| 8,626,446 | B2 | 1/2014 | Dong et al. |
| 2012/0298420 | A1 | 11/2012 | Seydoux et al. |
| 2023/0375739 | A1 | 11/2023 | Wang et al. |

FOREIGN PATENT DOCUMENTS

| | | | |
|---|---|---|---|
| BR | 112018072967 | B1 | 5/2023 |

OTHER PUBLICATIONS

Kyi, Ko Ko et al., "Are the LWD resistivity logs telling the whole story?" The 20th Formation Evaluation Symposium of Japan, Oct. 1-2, 2014 (Year: 2014).*

Schlumberger, "Oilfield Glossary: logging while drilling", Accessed via the Wayback Machine on Mar. 25, 2026 at https://web.archive.org/web/20160131212828/http://www.glossary.oilfield.slb.com/Terms/l/logging_while_drilling.aspx (Year: 2016).*

* cited by examiner

*Primary Examiner* — Andrew Schechter
*Assistant Examiner* — Ethan Wesley Edwards
(74) *Attorney, Agent, or Firm* — Kyle R. Miiller

(57) ABSTRACT

Aspects of the disclosure provide for using anticorrelation in propagation resistivity logs to detect boundary approaching conditions. Geosteering may be performed based on the detected boundary approaching conditions. The boundary detection and geosteering may be for a high angle well. The anticorrelation may be between attenuation resistivity and phase shift resistivity.

20 Claims, 15 Drawing Sheets

ANTICORRELATION IN PROPAGATION RESISTIVITY LOGS FOR GEOSTEERING

CROSS-REFERENCE TO RELATED APPLICATION

This application claims the benefit of U.S. Provisional Patent Application No. 63/635,247, filed Apr. 17, 2024, which is expressly incorporated by reference in its entirety.

BACKGROUND

Field of the Disclosure

The disclosure relates to geosteering.

Description of Related Art

In the field of oil and gas exploration, the efficient extraction of hydrocarbon resources is critical for maximizing production and minimizing costs.

Drilling equipment may be utilized to drill into rock of a geologic region, for example, to form a borehole and equipment may be utilized to form a completed well from the borehole. Traditional drilling techniques involve drilling vertically or directionally based on pre-existing geological models and seismic data. However, these methods may not always accurately predict the subsurface conditions encountered during drilling. Geosteering addresses this limitation by integrating measurements taken at the drill bit with geological and geophysical data to make informed decisions about the well path in real-time.

Geosteering is a technique employed during drilling operations to navigate the wellbore through subsurface formations in order to intersect target zones containing reservoirs of oil or natural gas. Geosteering involves real-time monitoring of geological parameters and adjusting the trajectory of the drilling path accordingly to optimize the placement of the wellbore within the reservoir.

One of the key components of geosteering is the use of measurement-while-drilling (MWD) and logging-while-drilling (LWD) technologies. These technologies enable the collection of various downhole measurements such as gamma ray, resistivity, density, and porosity, among others, while drilling progresses. These measurements provide valuable insights into the lithology, fluid content, and structural characteristics of the formations being drilled. The collected data is transmitted to the surface in real-time, where it is processed and interpreted by geologists and drilling engineers. By analyzing the geological properties of the formation ahead of the drill bit, decisions can be made to adjust the wellbore trajectory to optimize its placement within the reservoir. For example, this may involve steering the wellbore towards zones with higher porosity and permeability, which are indicative of potential hydrocarbon reservoirs, while avoiding undesirable formations such as shale or low-permeability zones. Advanced geosteering techniques utilize sophisticated algorithms and modeling software to predict the subsurface conditions ahead of the drill bit based on the collected data. These predictive models enable proactive decision-making and allow for more accurate placement of the wellbore within the reservoir, optimal reservoir drainage, enhancing reservoir recovery and production rates, and ultimately improving the overall efficiency and profitability of oil and gas projects.

There exists a need for further improvements in geosteering.

SUMMARY

The disclosure provides techniques for using anticorrelation in propagation resistivity logs for geosteering.

Some aspects provide a method for using anticorrelation in propagation resistivity logs for geosteering. A method for geosteering includes collecting LWD measurements during drilling of a well. The LWD measurements include but not limited to propagation resistivity response data. The method includes determining one or more attenuation resistivity values and one or more phase shift resistivity values from the propagation resistivity response data. The method includes identifying an anticorrelation between the one or more attenuation resistivity values and the one or more phase shift resistivity values. The method includes making a geosteering decision for the drilling of the well in response to the identified anticorrelation.

Some aspects provide a system for using anticorrelation in propagation resistivity logs for geosteering. The system includes one or more LWD tools configured to collect LWD measurements during drilling of a well. The LWD measurements include but not limited to propagation resistivity response data. The system includes one or more processors configured to: determine one or more attenuation resistivity values and one or more phase shift resistivity values from the propagation resistivity response data; identify an anticorrelation between the one or more attenuation resistivity values and the one or more phase shift resistivity values; and make a geosteering decision for the drilling of the well in response to the identified anticorrelation.

Some aspects provide a computer readable medium storing computer executable code for using anticorrelation in propagation resistivity logs for geosteering. Computer executable code for geosteering includes code for collecting LWD measurements during drilling of a well. The LWD measurements include but not limited to propagation resistivity response data. The computer executable code includes code for determining one or more attenuation resistivity values and one or more phase shift resistivity values from the propagation resistivity response data. The computer executable code includes code for identifying an anticorrelation between the one or more attenuation resistivity values and the one or more phase shift resistivity values. The computer executable code includes code for making a geosteering decision for the drilling of the well in response to the identified anticorrelation.

The following description and the appended figures set forth certain features for purposes of illustration.

BRIEF DESCRIPTION OF DRAWINGS

The figures show several embodiments of the system according to the disclosure.

DETAILED DESCRIPTION

Figure 1:
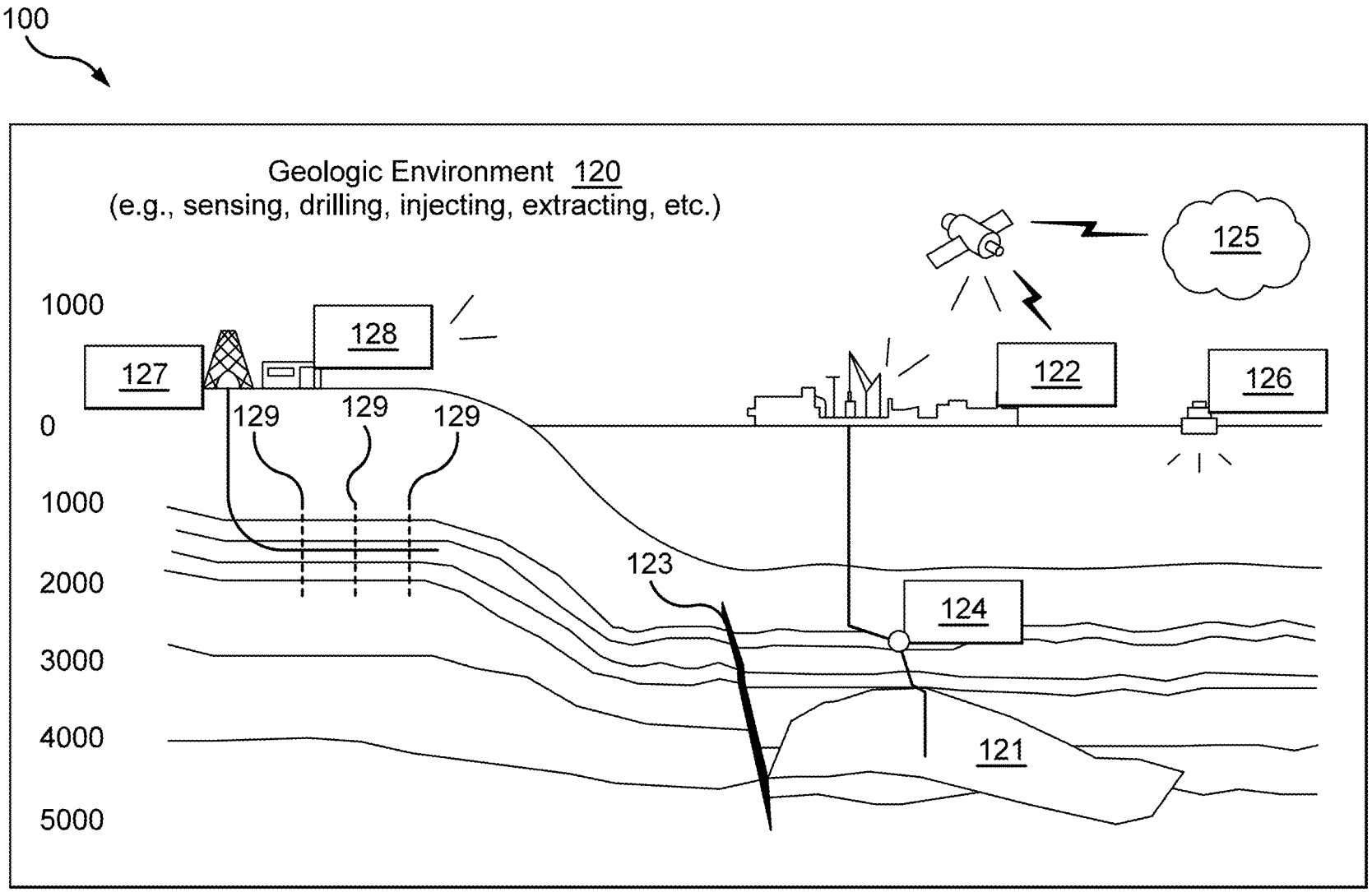
FIG. 1 illustrates an example drilling site and wellbore system.

The disclosure provides techniques, methods, systems, apparatus, and computer readable media for using anticorrelation in propagation resistivity logs to detect a boundary approaching condition. In some aspects, anticorrelation in propagation resistivity logs (e.g., LWD propagation resistivity logs) may be used to detect boundary approaching in a high resistivity zone (e.g., higher than 200 Ohm meters (Ohm·m)) of a well. In some aspects, anticorrelation in propagation resistivity logs may be used to detect boundary approaching in a high angle well (e.g., a horizontal well).

In some aspects, the anticorrelation is detected between apparent attenuation resistivity and phase shift resistivity curves in, or generated from, the propagation resistivity logs. In some aspects, detection of the anticorrelation in the propagation resistivity logs indicates the trajectory is close to a bed boundary with resistivity contrast. In some aspects, a magnitude of the anticorrelation indicates a distance to the bed boundary. In some aspects, a magnitude of the anticorrelation correlates to a variance of tortuosity. For example, a larger magnitude of the anticorrelation in the propagation resistivity logs may correlate with a wavier (e.g., more tortuosity variance) trajectory. In some aspects, a combination of the magnitude of the anticorrelation and the tortuosity of the well may be used to determine the distance to the bed boundary. In some aspects, the distance to boundary may be estimated using a look up table or a trained machine learning model. In some aspects, the anticorrelation may be used to determine additional information, such as formation properties.

In some aspects, when the anticorrelation in the propagation resistivity logs is detected at a point, an "approaching bed boundary" a warning indicator may be set (e.g., a yellow color indicator). In some aspects, when the anticorrelation in the propagation resistivity logs is detected at a point, an "approaching bed boundary" a danger indicator may be set (e.g., a red color indicator). In some aspects, the indicator may provide a quality check on surface inversions, which may quantify multi-layer resistivities as well as a distance to the bed boundary.

The following description includes embodiments of the best mode presently contemplated for practicing the described implementations. This description is not to be taken in a limiting sense, but rather is made merely for the purpose of describing the general principles of the implementations. The scope of the described implementations should be ascertained with reference to the issued claims.

Aspects of the disclosure related wellbore exploration and drilling for recovery of hydrocarbons. Various operations can be performed in a field. For example, exploration may be an initial phase in petroleum operations that includes generation of a prospect or play or both, and drilling of an exploration well or borehole. Appraisal, development and production phases may follow successful exploration.

A borehole may be referred to as a wellbore and can include an openhole portion or an uncased portion and/or may include a cased portion. A borehole may be defined by a bore wall that is composed of a rock that bounds the borehole.

Exploration, sensing, production, injection or other operation(s) for a well or borehole can be planned. Such a process may be referred to generally as well planning, a process by which a path can be mapped in a geologic environment. Such a path may be referred to as a trajectory, which can include coordinates in a three-dimensional coordinate system where a measure along the trajectory may be a measured depth, a total vertical depth or another type of measure. During drilling, wireline investigations, etc., equipment may be moved into and/or out of a well or borehole. Such operations can occur over time and may differ with respect to time. As an example, drilling can include using one or more logging tools that can perform one or more logging operations while drilling or otherwise with a drillstring (e.g., while stationary, while tripping in, tripping out, etc.). As an example, a wireline operation can include using one or more logging tools that can perform one or more logging operations. Wireline operations may utilize a cable that can include one or more electrical conductors that may provide for transmission of power, data, instructions, etc. A planning process may call for performing various operations, which may be performed in serial, parallel, serial and parallel, etc.

Example Wells

FIG. 1 depicts an example components an example geologic environment 120. A geologic environment 120 may be a sedimentary basin that includes layers (e.g., stratification) that include a reservoir 121 and that may be, for example, intersected by a fault 123 (e.g., or faults).

The geologic environment 120 may be outfitted with a variety of sensors, detectors, actuators, etc. For example, equipment 122 may include communication circuitry to receive and/or to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment 126 may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, geolocation, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

As shown in FIG. 1, the geologic environment 120 may include equipment 127 and equipment 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc., may exist where an assessment of such variations may assist with planning, operations, etc. to develop the reservoir (e.g., via fracturing, injecting, extracting, etc.). The equipment 127 and/or equipment 128 may include components, a system, systems, etc., for fracturing, seismic sensing, analysis of seismic data, NMR logging, assessment of one or more fractures, injection, production, etc. The equipment 127 and/or equipment 128 may provide for measurement, collection, communication, storage, analysis, etc. of data such as, for example, formation data, fluid data, production data (e.g., for one or more produced resources), etc.

In some aspects, equipment is land-based. In some aspects, equipment is suitable for use in an offshore system. In some aspects, equipment may be mobile, for example carried by a vehicle. In some aspects, equipment can be assembled, disassembled, transported and re-assembled, etc.

In some aspects, equipment includes a platform, a derrick, a crown block, a line, a traveling block assembly, drawworks, and a landing (e.g., a monkeyboard). The line may be controlled at least in part via the drawworks such that the traveling block assembly travels in a vertical direction with respect to the platform. By drawing the line in, the drawworks may cause the line to run through the crown block and lift the traveling block assembly skyward away from the platform; whereas, by allowing the line out, the drawworks may cause the line to run through the crown block and lower the traveling block assembly toward the platform. Where the traveling block assembly carries pipe (e.g., casing, etc.), tracking of movement of the traveling block may provide an indication as to how much pipe has been deployed.

A derrick can be a structure used to support a crown block and a traveling block operatively coupled to the crown block at least in part via line. A derrick may be pyramidal in shape and offer a suitable strength-to-weight ratio. A derrick may be movable as a unit or in a piece by piece manner (e.g., to be assembled and disassembled).

Drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line can cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

A crown block can include a set of pulleys (e.g., sheaves) that can be located at or near a top of a derrick or a mast, over which line is threaded. A traveling block can include a set of sheaves that can be moved up and down in a derrick or a mast via line threaded in the set of sheaves of the traveling block and in the set of sheaves of a crown block. A crown block, a traveling block and a line can form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

A derrick person may be a rig crew member that works on a platform attached to a derrick or a mast. A derrick can include a landing on which a derrick person may stand. As an example, such a landing may be about 10 meters or more above a rig floor. In an operation referred to as trip out of the hole (e.g., pulling out of hole (POOH)), a derrick person may wear a safety harness that enables leaning out from the work landing (e.g., monkeyboard) to reach pipe in located at or near the center of a derrick or a mast and to throw a line around the pipe and pull it back into its storage location (e.g., fingerboards), for example, until it a time at which it may be desirable to run the pipe back into the bore. A rig may include automated pipe-handling equipment such that the derrick person controls the machinery rather than physically handling the pipe.

A trip may refer to the act of pulling equipment from a bore (e.g., POOH) and/or placing equipment in a bore (e.g., running in hole, RIH). A drillstring that can be pulled out of the hole and/or place or replaced in the hole. A pipe trip may be performed where a drill bit has dulled or has otherwise ceased to drill efficiently and is to be replaced.

Example Directional Well

To optimize hydrocarbon recovery and enhance drilling efficiency, the oil and gas industry has increasingly turned to high angle wells as a strategic drilling technique. High angle wells, also known as deviated or directional wells, are wells that deviate significantly from the vertical plane, often exceeding a deviation angle of 70 degrees from vertical. This departure from vertical drilling allows operators to access reservoirs that are inaccessible or challenging to reach with conventional vertical wells.

High angle wells maximize reservoir contact and production rates. By deviating the wellbore trajectory, operators can intersect multiple zones within the reservoir, effectively increasing the exposed rock surface area and facilitating improved fluid drainage. This increased contact with the reservoir can lead to enhanced hydrocarbon recovery and improved well performance.

High angle wells are particularly advantageous in scenarios where geological formations are structurally complex or where the target reservoir is laterally extensive but relatively thin. In such cases, drilling vertically may result in limited exposure to the productive zone, whereas deviating the wellbore allows for greater coverage and more efficient extraction of hydrocarbons.

Moreover, high angle wells offer operational benefits in terms of well placement and environmental impact. By drilling from a centralized surface location, operators can access multiple subsurface targets without the need for additional surface infrastructure. This reduces the environmental footprint of drilling operations and minimizes surface disturbance, making high angle wells an attractive option in environmentally sensitive areas or urban locations.

However, drilling high angle wells presents technical challenges that must be overcome to ensure successful execution. These challenges include maintaining wellbore stability, controlling drilling trajectory, and managing equipment limitations. Advanced drilling technologies such as rotary steerable systems, mud motors, and MWD tools play a crucial role in enabling precise wellbore navigation and control in high angle drilling scenarios.

Geosteering techniques, including real-time reservoir mapping and formation evaluation, are essential for optimizing high angle well trajectories and maximizing reservoir contact. By continuously monitoring formation properties while drilling progresses, operators can make informed decisions to steer the wellbore towards the most productive zones within the reservoir. In some aspects, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

A rotary steerable system (RSS) may be utilized for direction drilling. Directional drilling involves drilling into the Earth to form a deviated bore such that the trajectory of the bore is not vertical; rather, the trajectory deviates from vertical along one or more portions of the bore. As an example, a target may be located at a lateral distance from a surface location where a rig may be stationed. In such an example, drilling can commence with a vertical portion and then deviate from vertical (e.g., kickoff) such that the bore is aimed at the target and, eventually, reaches the target. A deviation from vertical may be specified according to one or more doglegs, which may be in terms of severity (e.g., dogleg severity (DLS)). Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; noting that a mud motor can present some challenges depending on factors such as rate of penetration (ROP), transferring weight to a bit (e.g., weight on bit (WOB)) due to friction, etc. A mud motor can be a positive displacement motor (PDM) that operates to drive a bit during directional drilling. A PDM operates as drilling fluid is pumped through it where the PDM converts hydraulic power of the drilling fluid into mechanical power to cause the bit to rotate. A PDM can operate in a so-called sliding mode, when the drillstring is not rotated from the surface. For example, directional drilling can involve using a rotary mode with surface rotation and can involve using a sliding mode where a mud motor rotates a bit without surface rotation. In a rotary mode, surface rotation and mud motor rotation may be utilized to rotate a bit.

A RSS can drill directionally where there is continuous rotation from surface equipment, which can alleviate the sliding of a steerable motor (e.g., a PDM). A RSS may be deployed when drilling directionally (e.g., deviated, horizontal, or extended-reach wells). A RSS can aim to minimize interaction with a borehole wall, which can help to preserve borehole quality. A RSS can aim to exert a relatively consistent side force akin to stabilizers that rotate with the drillstring or orient the bit in the desired direction while continuously rotating at the same number of rotations per minute as the drillstring.

Examples of types of holes that may be drilled at least in part using directional drilling technology include a slant hole, an S-shaped hole, a deep inclined hole, and a horizontal hole. A directional well can include several shapes where each of the shapes may aim to meet particular operational demands. As an example, a drilling process may be performed on the basis of information as and when it is relayed to a drilling engineer (e.g., a directional driller (DD)). Inclination and/or direction may be modified based on information received during a drilling process.

Figure 2:
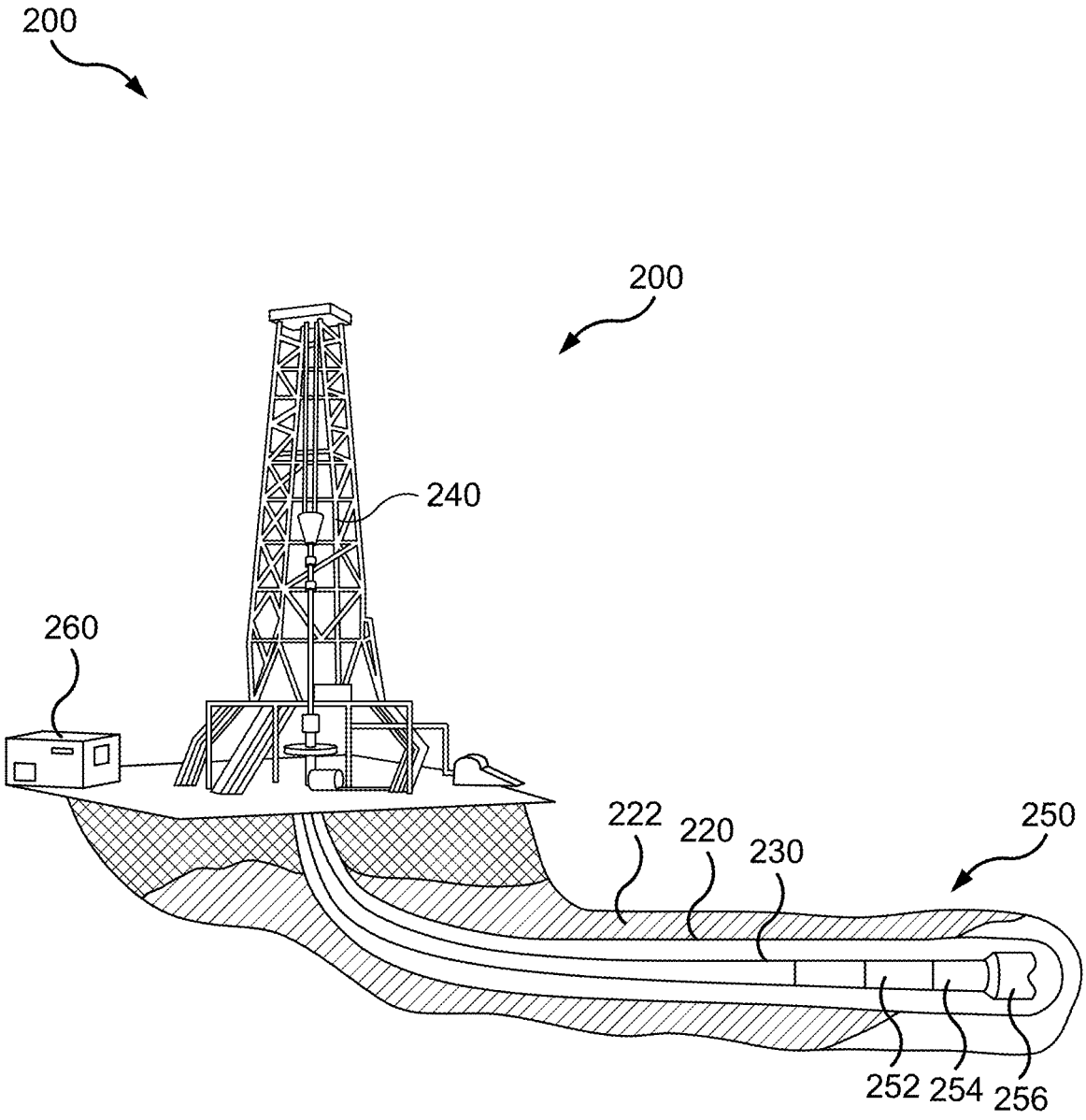
FIG. 2 illustrates a schematic view of a wellsite.

FIG. 2 shows a schematic diagram depicting an example of a drilling operation of a directional well in multiple sections. The drilling operation depicted in FIG. 2 includes a wellsite drilling system 200 and a field management tool for managing various operations associated with drilling a bore hole of a directional well 250. The wellsite drilling system 200 includes various components (e.g., drillstring 230, annulus 220, bottom hole assembly (BHA), kelly 240, mud pit 222, etc.). As shown in the example of FIG. 2, a target reservoir may be located away from (as opposed to directly under) the surface location of the well. In such an example, special tools or techniques may be used to ensure that the path along the bore hole reaches the particular location of the target reservoir.

As an example, the BHA may include sensors 252, a RSS 254, and a bit 256 to direct the drilling toward the target guided by a pre-determined survey program for measuring location details in the well. Furthermore, the subterranean formation through which the directional well 250 is drilled may include multiple layers (not shown) with varying compositions, geophysical characteristics, and geological conditions. Both the drilling planning during the well design stage and the actual drilling according to the drilling plan in the drilling stage may be performed in multiple sections, which may correspond to one or more of the multiple layers in the subterranean formation. For example, certain sections may use cement reinforced casing due to the particular formation compositions, geophysical characteristics, and geological conditions.

In the example of FIG. 2, a surface unit 260 may be operatively linked to the wellsite drilling system 200 and the field management tool via communication links. The surface unit 260 may be configured with functionalities to control and monitor the drilling activities by sections in real time via the communication link. The field management tool may be configured with functionalities to store oilfield data (e.g., historical data, actual data, surface data, subsurface data, equipment data, geological data, geophysical data, target data, anti-target data, etc.) and determine relevant factors for configuring a drilling model and generating a drilling plan. The oilfield data, the drilling model, and the drilling plan may be transmitted via the communication link according to a drilling operation workflow. The communication links may include a communication subassembly.

During various operations at a wellsite, data can be acquired for analysis and/or monitoring of one or more operations. Such data may include, for example, subterranean formation, equipment, historical and/or other data. Static data can relate to, for example, formation structure and geological stratigraphy that define the geological structures of the subterranean formation. Static data may also include data about a bore, such as inside diameters, outside diameters, and depths. Dynamic data can relate to, for example, fluids flowing through the geologic structures of the subterranean formation over time. The dynamic data may include, for example, pressures, fluid compositions (e.g. gas oil ratio, water cut, and/or other fluid compositional information), and states of various equipment, and other information.

The static and dynamic data collected via a bore, a formation, equipment, etc. may be used to create and/or update a three dimensional model of one or more subsurface formations. As an example, static and dynamic data from one or more other bores, fields, etc. may be used to create and/or update a three dimensional model. As an example, hardware sensors, core sampling, and well logging techniques may be used to collect data. As an example, static measurements may be gathered using downhole measurements, such as core sampling and well logging techniques. Well logging involves deployment of a downhole tool into the wellbore to collect various downhole measurements, such as density, resistivity, etc., at various depths. Such well logging may be performed using, for example, a drilling tool and/or a wireline tool, or sensors located on downhole production equipment. Once a well is formed and completed, depending on the purpose of the well (e.g., injection and/or production), fluid may flow to the surface (e.g., and/or from the surface) using tubing and other completion equipment. As fluid passes, various dynamic measurements, such as fluid flow rates, pressure, and composition may be monitored. These parameters may be used to determine various characteristics of a subterranean formation, downhole equipment, downhole operations, etc.

Well construction can occur according to various procedures, which can be in various forms. As an example, a procedure can be specified digitally and may be, for example, a digital plan such as a digital well plan. A digital well plan can be an engineering plan for constructing a wellbore. As an example, procedures can include information such as well geometries, casing programs, mud considerations, well control concerns, initial bit selections, offset well information, pore pressure estimations, economics and special procedures that may be utilized during the course of well construction, production, etc. While a drilling procedure can be carefully developed and specified, various conditions can occur that call for adjustment to a drilling procedure.

As an example, an adjustment can be made at a rigsite when acquisition equipment acquire information about conditions, which may be for conditions of drilling equipment, conditions of a formation, conditions of fluid(s), conditions as to environment (e.g., weather, sea, etc.), etc. Such an adjustment may be made on the basis of personal knowledge of one or more individuals at a rigsite. As an example, an operator may understand that conditions call for an increase in mudflow rate, a decrease in weight on bit, etc. Such an operator may assess data as acquired via one or more sensors (e.g., torque, temperature, vibration, etc.). Such an operator may call for performance of a procedure, which may be a test procedure to acquire additional data to understand better actual physical conditions and physical phenomena that may occur or that are occurring. An operator may be under one or more time constraints, which may be driven by physical phenomena, such as fluid flow, fluid pressure, compaction of rock, borehole stability, etc. In such an example, decision making by the operator can depend on time as conditions evolve. For example, a decision made at one fluid pressure may be sub-optimal at another fluid pressure in an environment where fluid pressure is changing. In such an example, timing as to implementing a decision as an adjustment to a procedure can have a broad ranging impact. An adjustment to a procedure that is made too late or too early can adversely impact other procedures compared to an adjustment to a procedure that is made at an optimal time (e.g., and implemented at the optimal time).

Various types of downhole equipment may provide real time or near real time data of interest (e.g., inclination, direction, pressure, temperature, real weight on the drill bit, torque stress, etc.).

Sensors 252 may be operatively coupled to the control and/or data acquisition system in surface unit 260. A sensor or sensors may be at surface locations and/or or sensors may be at downhole locations. A sensor or sensor may be at an offset wellsite where the wellsite drilling system 200 and the offset wellsite are in a common field (e.g., oil and/or gas field).

Sensors 252 can be provided for tracking pipe, tracking movement of at least a portion of a drillstring, etc. Sensors 252 may sense and/or transmit signals to a fluid conduit such as a drilling fluid conduit (e.g., a drilling mud conduit). For example, in the system 200, the one or more sensors 252 can be operatively coupled to portions of the standpipe through which mud flows. As an example, a downhole tool can generate pulses that can travel through the mud and be sensed by one or more of the one or more sensors 252. In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 can include a transmitter that can generate signals that can be transmitted downhole via mud (e.g., drilling fluid) as a transmission medium.

In one example, a wireline tool or another type of tool may be utilized to make measurements. As an example, a tool may be configured to acquire electrical borehole images. A data acquisition sequence for such a tool can include running the tool into a borehole with acquisition pads closed, opening and pressing the pads against a wall of the borehole, delivering electrical current into the material defining the borehole while translating the tool in the borehole, and sensing current remotely, which is altered by interactions with the material.

Analysis of formation information may reveal features such as, for example, vugs, dissolution planes (e.g., dissolution along bedding planes), stress-related features, dip events, etc. As an example, a tool may acquire information that may help to characterize a reservoir, optionally a fractured reservoir where fractures may be natural and/or artificial (e.g., hydraulic fractures). As an example, information acquired by a tool or tools may be analyzed using a framework. As an example, a system can include a framework that can acquire data such as, for example, real time data associated with one or more operations such as, for example, a drilling operation or drilling operations.

The system 200 may include a LWD module and/or a MWD module. Such components or modules may be referred to as tools. For example, a LWD module may be housed in a suitable type of drill collar and can include one or a plurality of selected types of logging tools (e.g., NMR unit or units, etc.). More than one LWD and/or MWD module can be employed. A MWD module may be housed in a suitable type of drill collar and can include one or more devices for measuring characteristics of the drillstring 230 and the drill bit 256. As an example, the MWD tool may include equipment for generating electrical power, for example, to power various components of the drillstring 230. As an example, the MWD tool may include the telemetry equipment, for example, where the turbine impeller can generate power by flow of the mud; noting that other power and/or battery systems may be employed for purposes of powering one or more components. As an example, the MWD module may include one or more of the following types of measuring devices: a weight-on-bit measuring device, a torque measuring device, a vibration measuring device, a shock measuring device, a stick slip measuring device, a direction measuring device, and an inclination measuring device.

LWD and/or MWD equipment can make it possible to send to the surface various types of data of interest, including for example, geological data (e.g., gamma ray log, resistivity, density and sonic logs, etc.). In some aspects, one or more NMR measuring devices (e.g., NMR units, etc.) may be included in a drillstring (e.g., a BHA, etc.) where, for example, measurements may support one or more of geosteering, geostopping, trajectory optimization, etc. The coupling of sensors providing information on the course of a well trajectory, in real time or near real time, with, for example, one or more logs characterizing the formations from a geological viewpoint, can allow for implementing a geosteering method. Such a method can include navigating a subsurface environment, for example, to follow a desired route to reach a desired target or targets.

In some aspects, a drillstring can include an azimuthal density neutron (ADN) tool for measuring density and porosity. A drillstring may include a MWD tool for measuring inclination, azimuth and shocks. A drillstring may include a compensated dual resistivity (CDR) tool for measuring resistivity and gamma ray related phenomena. A drillstring may include a combinable magnetic resonance (CMR) tool for measuring properties (e.g., relaxation properties, etc.); one or more variable gauge stabilizers; one or more bend joints. A drillingstring may include a geosteering tool, which may include a motor and optionally equipment for measuring and/or responding to one or more of inclination, resistivity and gamma ray related phenomena.

Example Propagation Resistivity Logging

As mentioned, MWD and LWD technologies enable the real-time collection of downhole measurements, including resistivity. The resistivity of a formation is a key indicator of the lithology and fluid content.

Propagation resistivity logging utilizes electromagnetic principles to measure the resistivity of the surrounding formation as the drilling assembly advances downhole. Propagation resistivity logging involves the transmission of electromagnetic waves from an antenna located on the drilling tool into the formation. These electromagnetic waves propagate through the formation, and their propagation characteristics are influenced by the electrical properties of the rocks and fluids encountered. For example, electromagnetic waves may be emitted at various frequencies and the attenuation and phase shift of the transmitted signals are measured as the electromagnetic waves propagate through the formation. These measurements are then processed to derive formation resistivity values at different depths along the borehole trajectory. Advanced signal processing algorithms and inversion techniques can be employed to interpret the data and generate high-resolution resistivity logs in real-time.

Hydrocarbon-bearing formations typically exhibit higher resistivity due to the insulating properties of oil and gas compared to water-saturated formations. By measuring the resistivity of the formation surrounding the borehole, propagation resistivity logging provides valuable information about the presence and distribution of hydrocarbons, as well as the type of fluids present (oil, water, or gas).

The real-time nature of LWD and/or MWD propagation resistivity logging allows drilling engineers and geoscientists to make informed decisions about wellbore placement and reservoir evaluation while drilling is in progress. By continuously monitoring formation resistivity, operators can identify hydrocarbon-bearing intervals, delineate reservoir boundaries, and optimize drilling trajectories to maximize reservoir contact and production potential, thereby enhancing drilling efficiency, reducing uncertainty, and ultimately contributing to the successful exploration and development of hydrocarbon resources.

One measurement in propagation resistivity logging is attenuation resistivity, for example, apparent resistivity from attenuation-deep (Rad). Rad is a parameter measured and analyzed during the exploration phase to gain insights into the electrical properties of the formations surrounding the borehole. Attenuation resistivity, also known as apparent resistivity, is a measure of the ability of a formation to impede the flow of electrical current. Rad is determined by analyzing the response of the formation to electromagnetic waves transmitted from a logging tool deployed within the borehole. These electromagnetic waves propagate through the formation, and their attenuation, or weakening, is influenced by the resistivity distribution of the surrounding rocks and fluids.

The Rad measurement process involves emitting electromagnetic waves at various frequencies from the logging tool into the formation. As these waves propagate, they interact with the subsurface materials, including rocks, pore fluids, and any conductive minerals present. The attenuation of the transmitted signals is then detected and recorded by sensors in the logging tool.

The Rad measurements provide valuable information about the distribution and properties of fluids within the formation. Hydrocarbon-bearing formations typically exhibit higher resistivity due to the insulating properties of oil and gas compared to water-saturated formations. By analyzing the attenuation resistivity data, geoscientists and drilling engineers can infer the presence of hydrocarbons and evaluate the fluid saturation levels in the reservoir.

One of the advantages of attenuation resistivity measurements is their sensitivity to small-scale variations in formation properties. Unlike traditional resistivity measurements, which may be influenced by borehole conditions and tool effects, attenuation resistivity provides a bulk measurement of the formation properties surrounding the borehole. This enables the detection of subtle changes in lithology, fluid content, and reservoir quality, even in challenging drilling environments.

Another measurement in propagation resistivity logging is the phase shift resistivity also referred to as phase difference resistivity, for example, apparent phase shift resistivity-shallow (Rps). Phase shift resistivity is a fundamental parameter measured and analyzed during the exploration phase to gain insights into the electrical properties of the formations surrounding the borehole. Phase shift resistivity is a measure of the phase shift between the transmitted and received electromagnetic waves as they propagate through the formation surrounding the borehole. Rps is determined by analyzing the response of the formation to electromagnetic waves emitted from a logging tool deployed within the borehole. The phase shift is influenced by the resistivity distribution and dielectric properties of the subsurface materials.

The Rps measurement process involves emitting electromagnetic waves at multiple frequencies from the logging tool into the formation. These waves propagate through the formation and interact with the rocks, pore fluids, and conductive minerals present. As the waves propagate, their phase is altered by the electrical properties of the formation, leading to a phase shift between the transmitted and received signals.

Phase shift resistivity measurements provide valuable insights into the distribution and properties of fluids within the formation. Hydrocarbon-bearing formations typically exhibit distinct phase shifts due to the differences in dielectric properties between oil, gas, and water. By analyzing the phase shift data across multiple frequencies, geoscientists and drilling engineers can infer the presence of hydrocarbons and evaluate the fluid saturation levels in the reservoir.

One of the advantages of phase shift resistivity measurements is their sensitivity to changes in formation properties, particularly in formations with complex lithologies or fluid distributions. Unlike traditional resistivity measurements, which may be influenced by borehole conditions and tool effects, phase shift resistivity provides a bulk measurement of the formation properties surrounding the borehole. This enables the detection of subtle changes in lithology, fluid content, and reservoir quality, even in challenging drilling environments.

Modern logging tools incorporate multiple transmitter-receiver configurations and sophisticated data processing techniques to mitigate borehole effects and improve the resolution of the measured Rad and Rps data.

Anticorrelation in Propagation Resistivity Logging for Boundary Approaching Detection Aspects of the present disclosure provide relate to geosteering using anticorrelation in propagation resistivity logging. As mentioned above, geosteering plays a pivotal role by enabling precise wellbore placement within subsurface formations. Propagation resistivity logging provides data for real-time assessment of formation resistivity and fluid content. Aspects of the disclosure provide for detecting a boundary approaching condition using anticorrelation in propagation resistivity logging data.

"Boundary approaching" refers to the proactive detection and navigation of geological boundaries, such as hydrocarbon-bearing formations, during drilling. Boundary detection is vital for optimizing wellbore trajectories and maximizing reservoir contact for enhanced production rates. Boundary approaching in geosteering with propagation resistivity logging involves the continuous monitoring of formation resistivity measurements as drilling advances through the subsurface. By analyzing changes in resistivity values, drilling engineers and geoscientists can identify the proximity of geological boundaries, such as interfaces between different lithological layers or transitions from hydrocarbon-bearing to water-saturated zones. Further properties of the formation may also be detected based on the anticorrelation of the propagation resistivity logging data.

Upon detecting the approach of a boundary, drilling engineers can make informed decisions regarding wellbore adjustments to optimize reservoir contact. Such decisions may involve steering the wellbore towards regions of higher resistivity, which typically indicate hydrocarbon-rich intervals, while avoiding low-resistivity zones associated with water or non-productive formations. By continuously updating the wellbore trajectory based on real-time resistivity data, operators can maximize reservoir drainage and ultimately enhance production efficiency.

Boundary approaching detection for geosteering may be enhanced with other downhole measurements, such as gamma ray, neutron porosity, and acoustic velocity logs. These multi-parameter datasets provide a comprehensive understanding of the subsurface geology and allow for more accurate reservoir characterization and navigation.

One challenge in boundary approaching is the interpretation of resistivity data in complex geological environments. Geological formations often exhibit heterogeneity and anisotropy, leading to variations in resistivity that may not be readily apparent.

In some cases, the attenuation resistivity and the phase shift resistivity in propagation resistivity data may be anticorrelated. Anticorrelation may refer to a relationship between two variables where one tends to decrease as the other increases, and vice versa. This phenomenon is distinct from correlation, where both variables either increase or decrease together. For example, typically, the attenuation resistivity and the phase shift resistivity in propagation resistivity data may be correlated. Thus, anticorrelation may be classified as an "abnormal" propagation resistivity response. For example, a field log may show anticorrelation in attenuation resistivity and the phase shift resistivity in a high angle well high resistivity section, where attenuation and phase shift resistivity curves in the field log data are separated, with variations along the measured depth, and periodic anticorrelation of the apparent attenuation resistivity and the phase shift resistivity.

According to certain aspects, boundary approaching conditions may be detected in response to identification of anticorrelation of the attenuation and phase shift resistivity in the propagation resistivity log. The boundary approaching conditions may be used to make real time high angle well geosteering decisions.

In some aspects, the anticorrelation of the apparent attenuation resistivity and the phase shift resistivity in propagation resistivity logging may be associated with a trajectory close to the bed boundary, with wellbore tortuosity, and/or with formation features such as high resistivity, shoulder bed, thin beds, anisotropy, dielectric, etc. Accordingly, the identification of anticorrelation can be used to determine the associated boundary approaching condition, tortuosity, and/or formation features.

Wellbore tortuosity refers to the deviation or curvature of a wellbore from its planned or intended path. In oil and gas drilling operations, engineers design wellbores to reach specific reservoir targets at certain depths and angles. However, during drilling, various factors such as geological formations, drilling equipment, and operational conditions can cause the wellbore to deviate from its planned trajectory. Tortuosity can occur in both vertical and horizontal wellbores. In some example, wellbore tortuosity is known, and the wellbore tortuosity can be used in addition to the anticorrelation to determine boundary approaching condition and/or formation features.

In some aspects, a magnitude of the anticorrelation can be determined and the magnitude of the anticorrelation may be used to detect boundary approaching conditions, such as distance to the bed.

Figure 3:
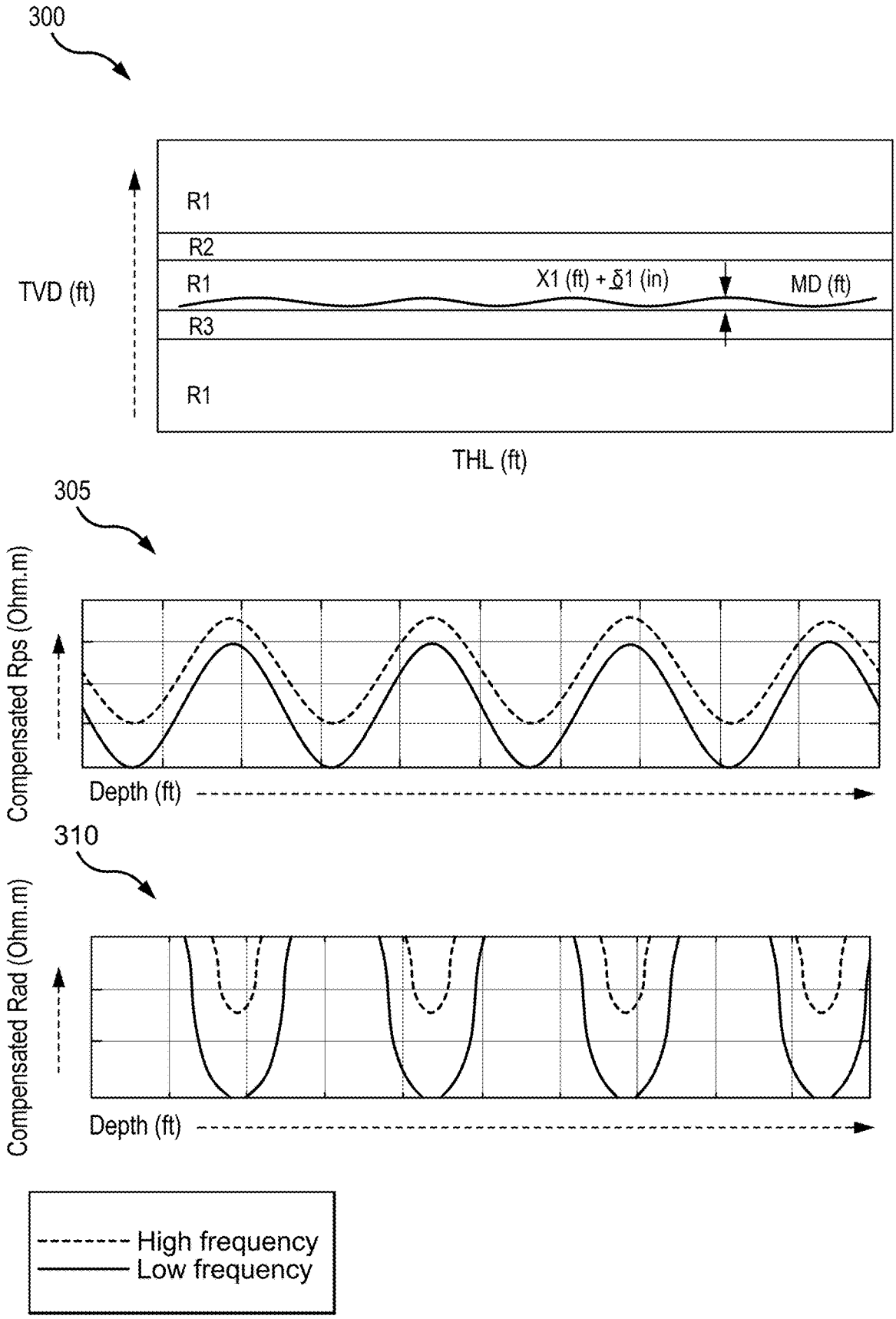
FIG. 3 illustrates example wellbore tortuosity with small depth variation.
Figure 4:
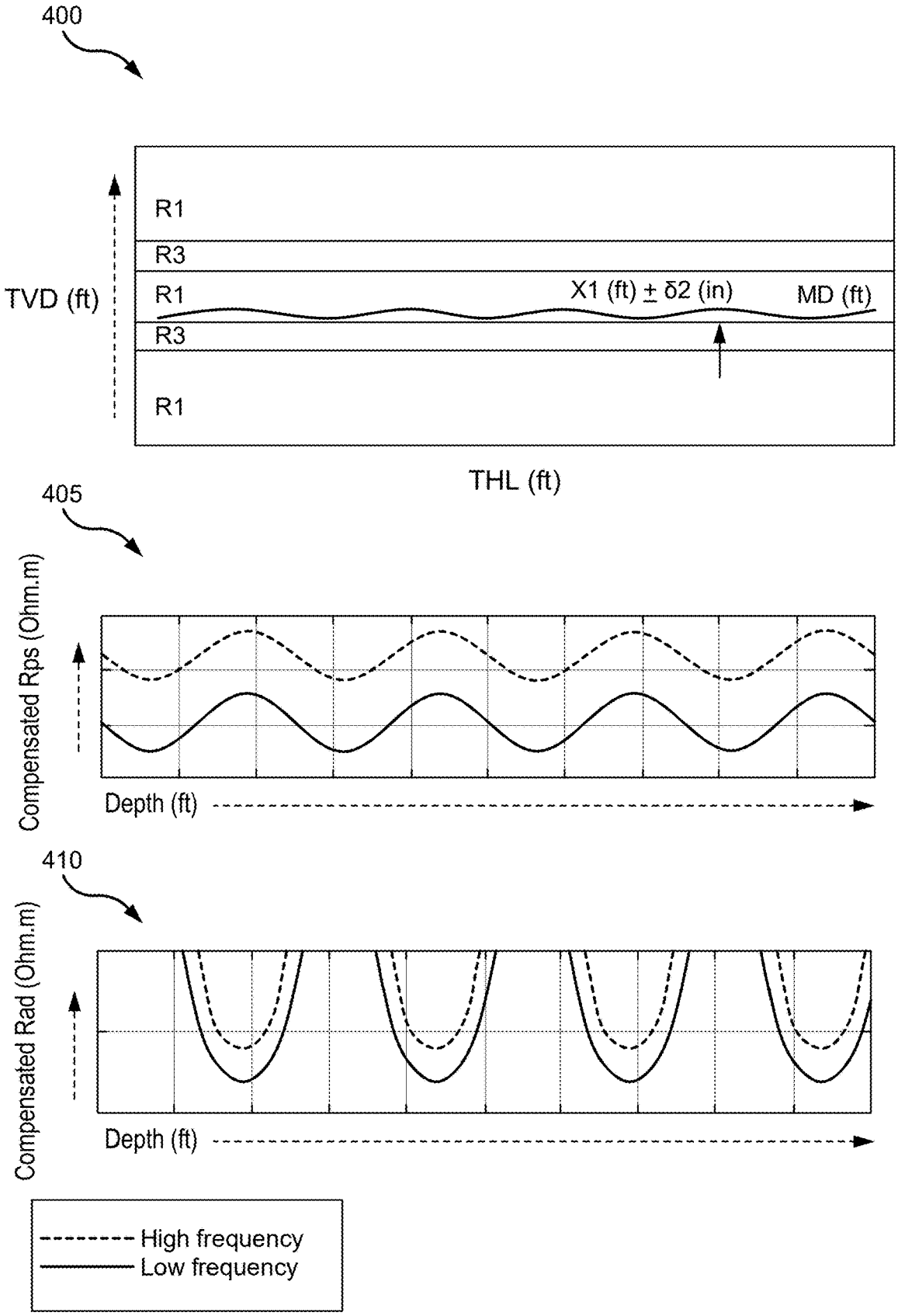
FIG. 4 illustrates another example wellbore tortuosity with small depth variation.
Figure 5:
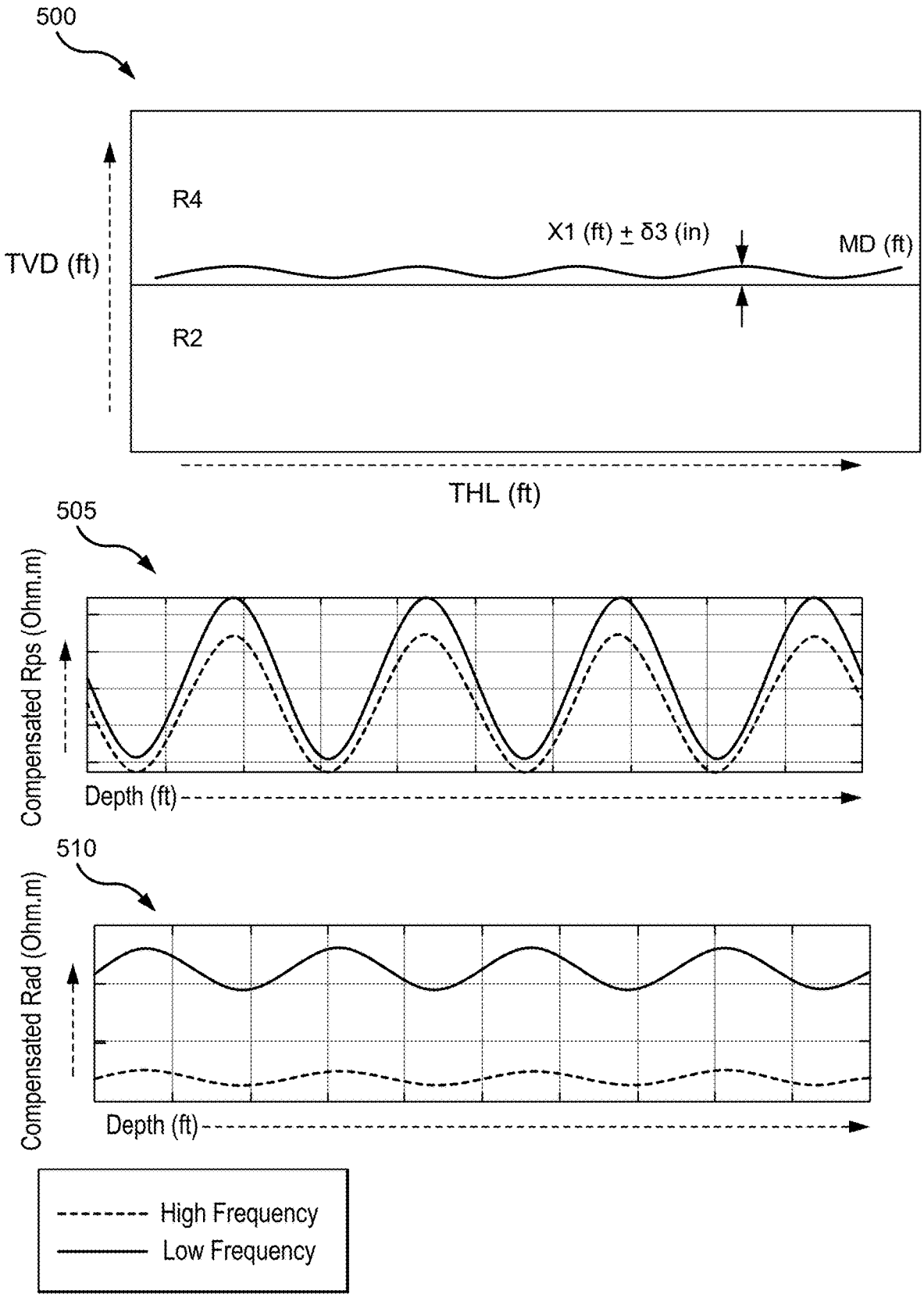
FIG. 5 illustrates a two-layer model example of wellbore tortuosity with small depth variation.

FIGS. 3-5 are graphs depicting example field logs with contrasted formation layers and horizontal well in high resistivity zones and wellbore tortuosity modeled with a small depth variation. In some aspects, in the depths are measured depth (MD), where measured depth is the length of the wellbore as measured along the actual path drilled from the surface to downhole point. MD may represent the total distance drilled, including deviations or turns made by the drill bit. In some aspects, depths are true vertical depth (TVD), where the TVD is the straight-line vertical distance from the surface to a point in the wellbore, not accounting for any lateral deviations. In some aspects, the propagation resistivity data may be shown as a function of the measured depth.

FIG. 3 is a graph 305 depicting example layered model simulated phase shift resistivity responses and a graph 310 depicting example layered model simulated attenuation resistivity responses, in a high resistivity layer for a trajectory 300 as a function of TVD and true horizontal length (THL). As shown in FIG. 3, the LWD propagation tool is navigating in a high resistivity (R1) layer, with two apparently conductive shoulder beds of lower resistivity (R2 and R3), and the far field is also high resistivity (R1). The well trajectory is X1 feet (e.g., 2 ft) away from the bed boundary, with a ±δ1 inch (e.g., ±6) in up and down variance. As shown, anticorrelation may be identified in the Rad and Rps curves which may allow detection of the boundary approaching condition. It should be noted that while the resistivity of certain layers are shown as the same (e.g., R1), the various layers may have different resistivity where certain layers have higher resistivity than other layers leading to resistivity contrast between the layers of higher resistivity with the layers of lower resistivity.

FIG. 4 is a graph 405 depicting example layered model simulated phase shift resistivity responses and a graph 410 depicting example layered model simulated attenuation resistivity responses, in a lower resistivity layer for a trajectory 400. As shown in FIG. 4, where the upper conductive shoulder bed resistivity is a lower resistivity (e.g., R3) and the trajectory variance is much smaller, ±δ2 inch (e.g., only ±1 in) up and down. As shown, a smaller magnitude anticorrelation may be identified which may allow detection of the boundary approaching condition.

FIG. 5 is a graph 505 depicting example two-layered model simulated phase shift resistivity responses and a graph 510 depicting example two-layered model simulated attenuation resistivity responses, for a trajectory 500 that is X1 (ft) with a variance ±δ3 inch (e.g., ±2 in) in a higher resistivity (R4) layer. As shown in FIG. 5, the anticorrelation may be identified in the Rad and Rps curves even in the two-layered case.

FIGS. 6-9 are graphs depicting example sensitivity of anticorrelation identified in the Rad and Rps curves in varied resistivity layers. In FIGS. 6-9, the yellow color zone above the diagonal indicates the shoulder bed is more resistive than the formation layer in which the anticorrelation occurs. For higher shoulder contrast (e.g., yellow color with value of 1), the Rad and Rps may be highly anticorrelated. For lower shoulder bed contrast (e.g., blue color with value of 0), the Rad and Rps may be correlated and follow each other.

Figure 6:
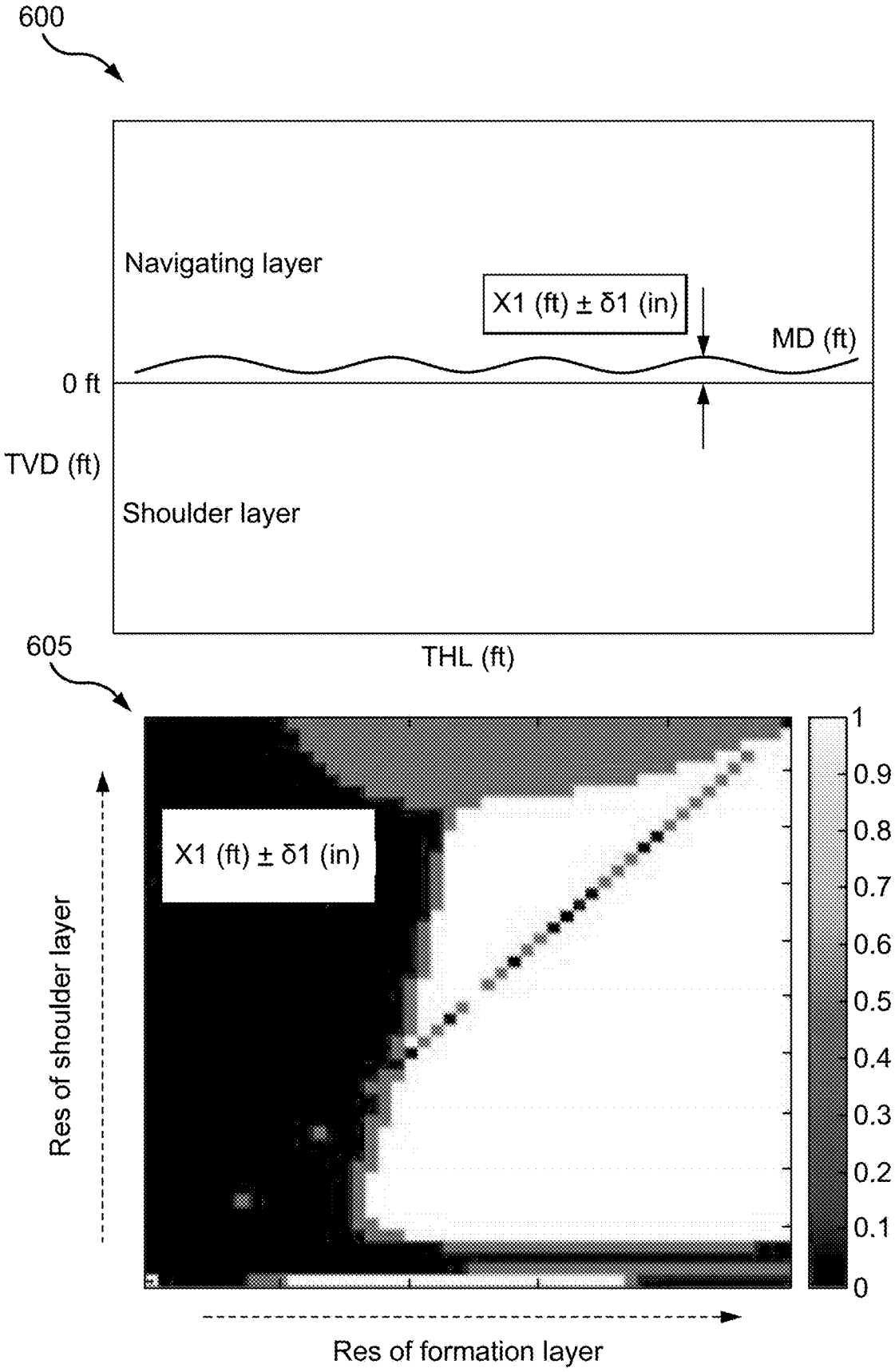
FIG. 6 illustrates a two-layer model example of wellbore tortuosity with small depth variation.

FIG. 6 is a graph 605 depicting shoulder bed layer and formation bed layer contrast and associated anticorrelation magnitude for an example trajectory 600 X1 feet (e.g., 2 ft) above the bed boundary (e.g., shoulder layers) with up and down variance of ±δ1 inch (e.g., ±6 in) over a range of layer resistivity (e.g., from 0.1 Ohm·m to 500 Ohm·m). As shown in FIG. 6, when formation resistivity is beyond 200 Ohm·m, and the shoulder bed resistivity is large (e.g., above 50 Ohm·m), anticorrelation of the Rad and Rps curves may be identified and boundary approaching conditions may be detected. As shown in FIG. 6, when the formation resistivity is low (e.g., below 160 Ohm·m), correlation of the Rad and Rps curves may be identified.

Figure 7:
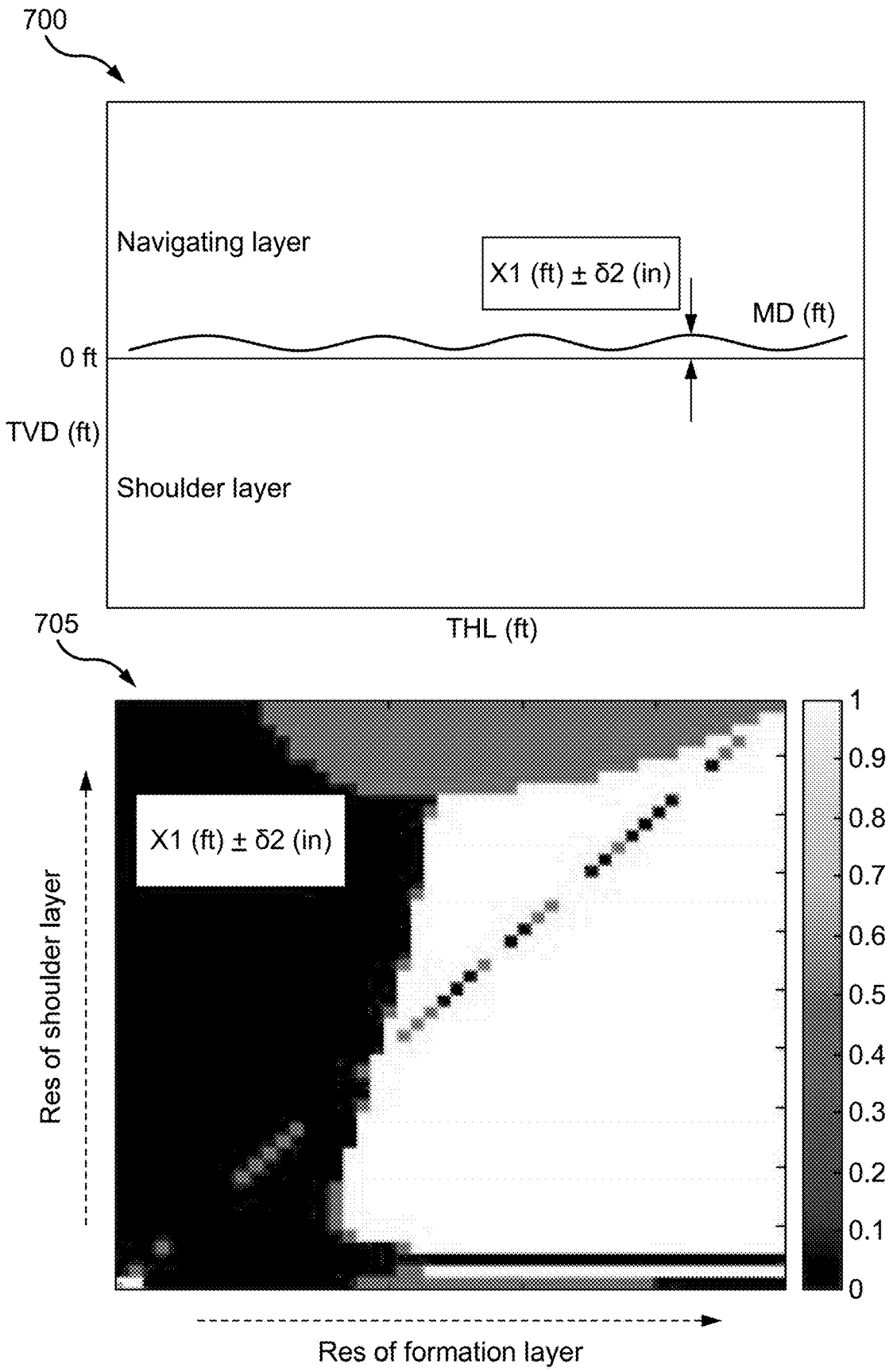
FIG. 7 illustrates another two-layer model example of wellbore tortuosity with small depth variation.

FIG. 7 is a graph 705 depicting shoulder bed layer and formation bed layer contrast and associated anticorrelation magnitude for an example trajectory 700 X1 feet (e.g., 2 ft) above the bed boundary with up and down variance of ±δ2 inch (e.g., ±1 in) over a range of layer resistivity (e.g., from 0.1 Ohm·m to 500 Ohm·m). As shown in FIG. 7, where the tortuosity variance is +82 inch as compared to the tortuosity variance of ±δ1 inches shown in FIG. 6, the sensitivity maps of the anticorrelation may be is similar.

Figure 8:
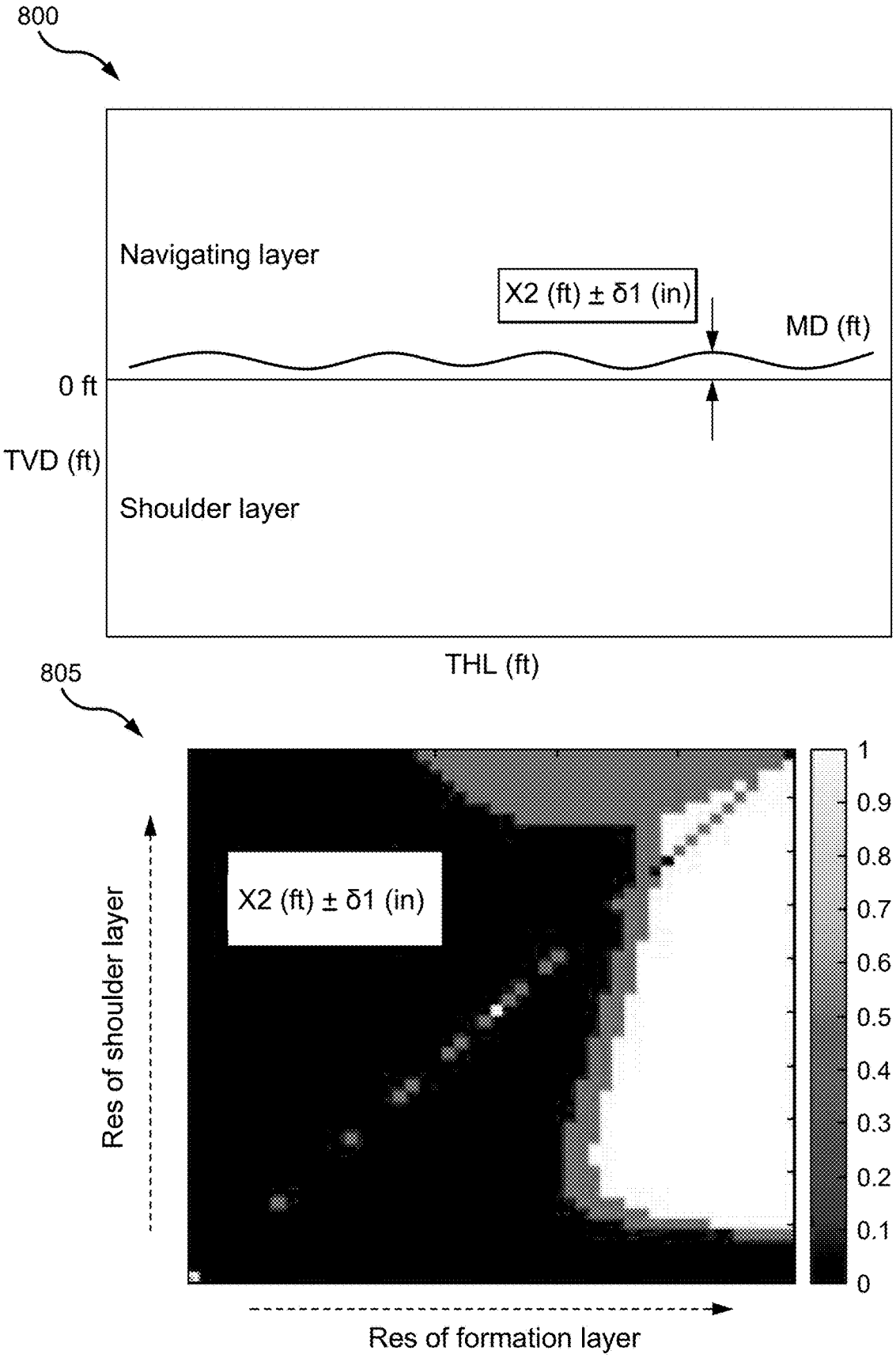
FIG. 8 illustrates another two-layer model example of wellbore tortuosity with small depth variation.

FIG. 8 is a graph 805 depicting shoulder bed layer and formation bed layer contrast and associated anticorrelation magnitude for an example trajectory 800 X2 feet (e.g., 4 ft) above the bed boundary with up and down variance of ±δ1 inches (e.g., ±6 in) over a range of layer resistivity (e.g., from 0.1 Ohm·m to 500 Ohm·m). As shown in FIG. 8, when the trajectory 800 is further from the boundary, the yellow zone is much smaller, where anticorrelation is only identified when the formation resistivity is higher (e.g., above 350 Ohm·m).

Figure 9:
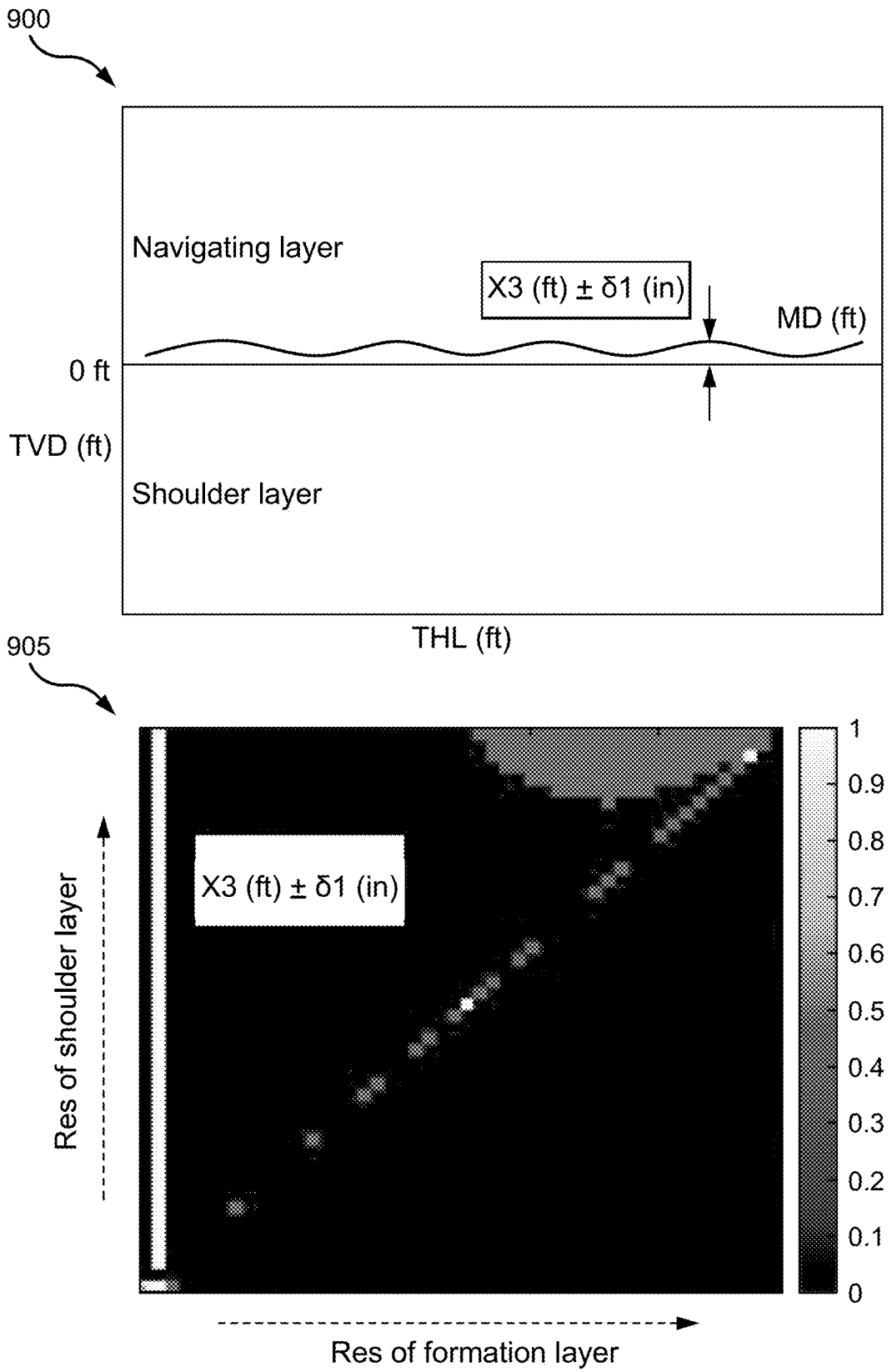
FIG. 9 illustrates another two-layer model example of wellbore tortuosity with small depth variation.

FIG. 9 is a graph 905 depicting shoulder bed layer and formation bed layer contrast and associated anticorrelation magnitude for an example trajectory 900 X3 feet (e.g., 6 ft) above the bed boundary with a trajectory up and down variance of ±δ1 inches (e.g., ±6 in) over a range of layer resistivity (e.g., from 0.1 Ohm·m to 500 Ohm·m). As shown in FIG. 9, when the trajectory 900 is even further from the boundary, the anticorrelation is not identified.

Figure 10:
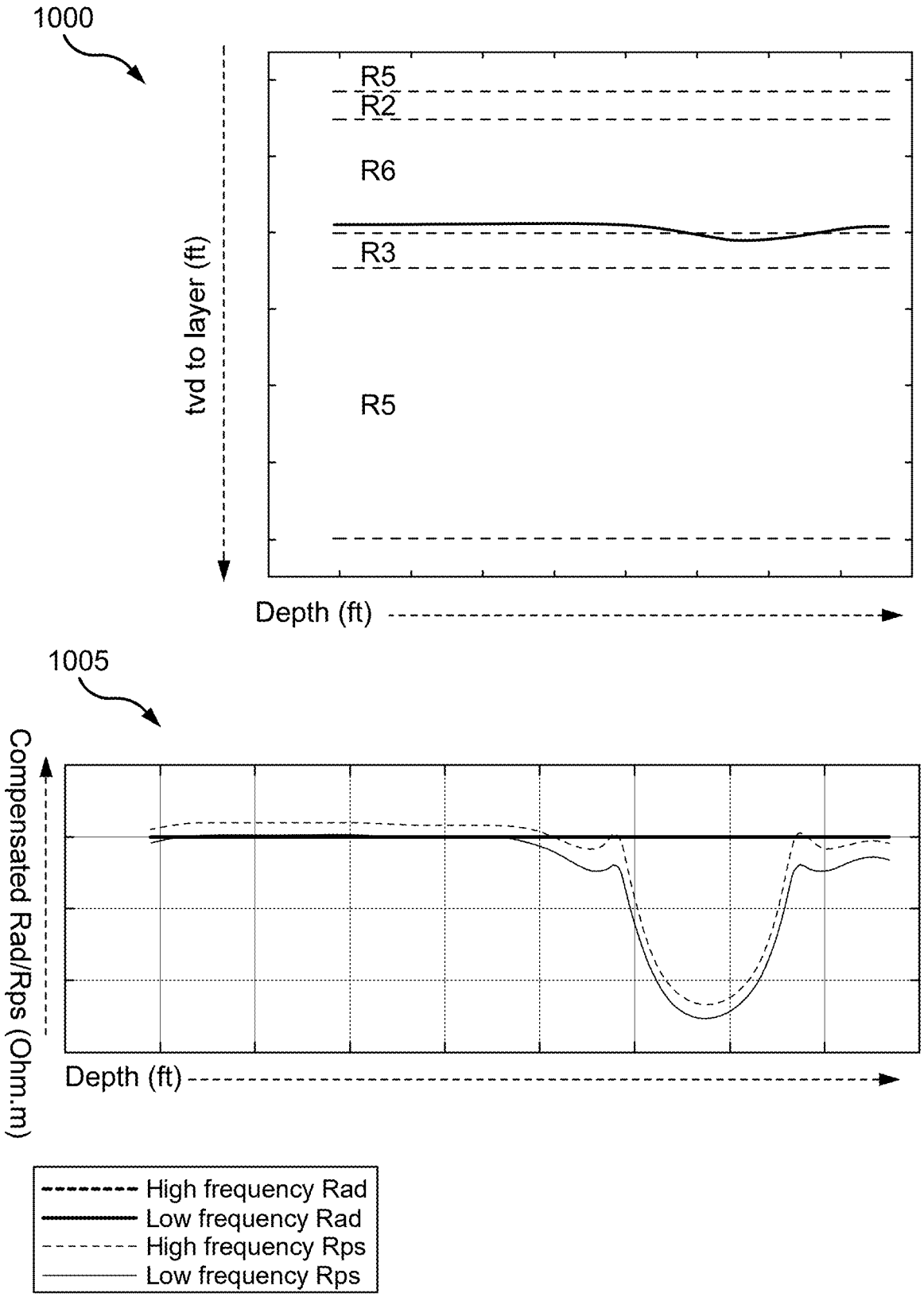
FIG. 10 illustrates example resistivity without wellbore tortuosity.

FIG. 10 is a graph 1005 modeling example resistivity responses without tortuosity for a trajectory 1000 in a high resistivity (R6) layer. As shown in FIG. 10, if there is no tortuosity associated with the trajectory, anticorrelation is not identified.

Figure 11:
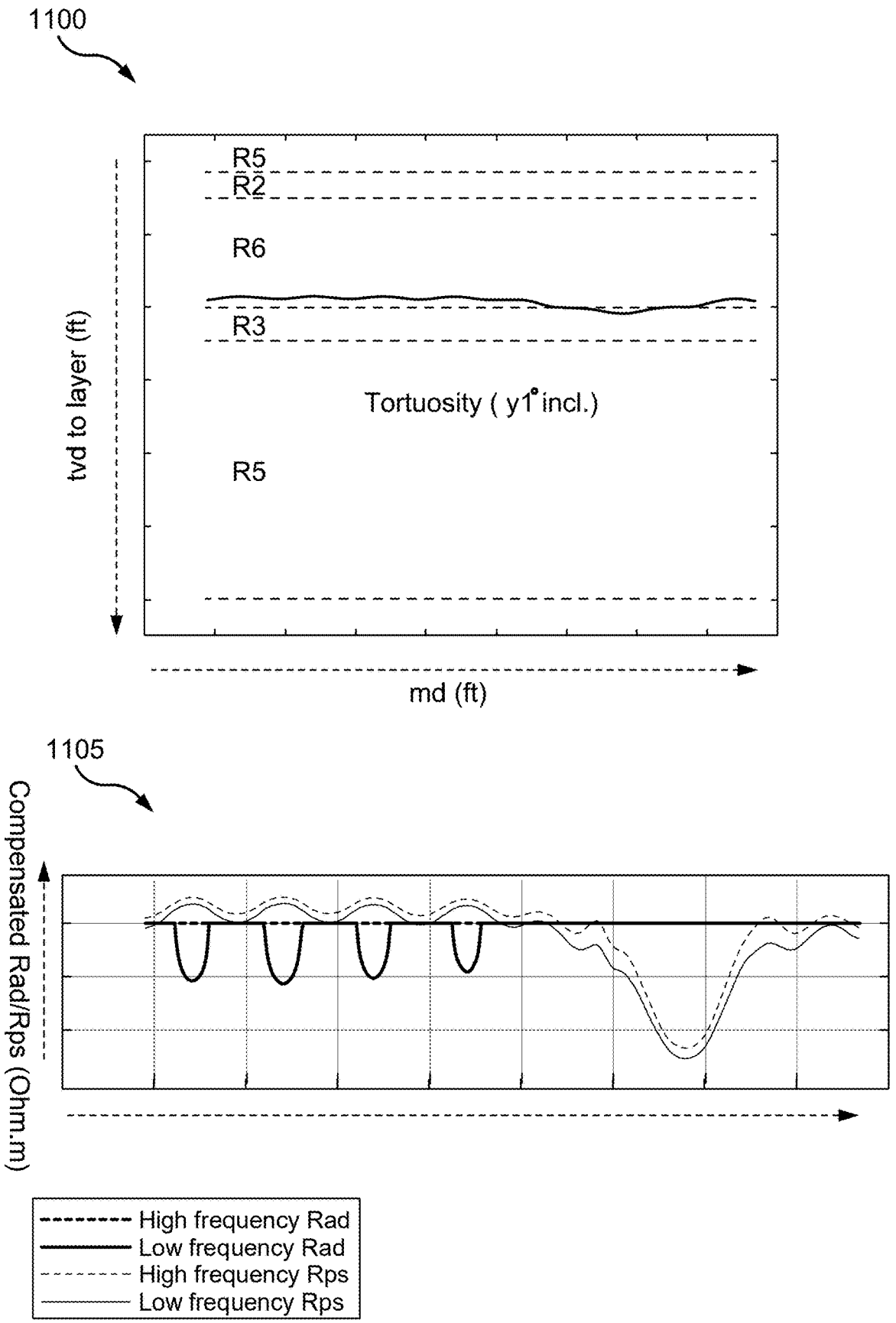
FIG. 11 illustrates example resistivity with wellbore tortuosity for a well with a first inclination.
Figure 12:
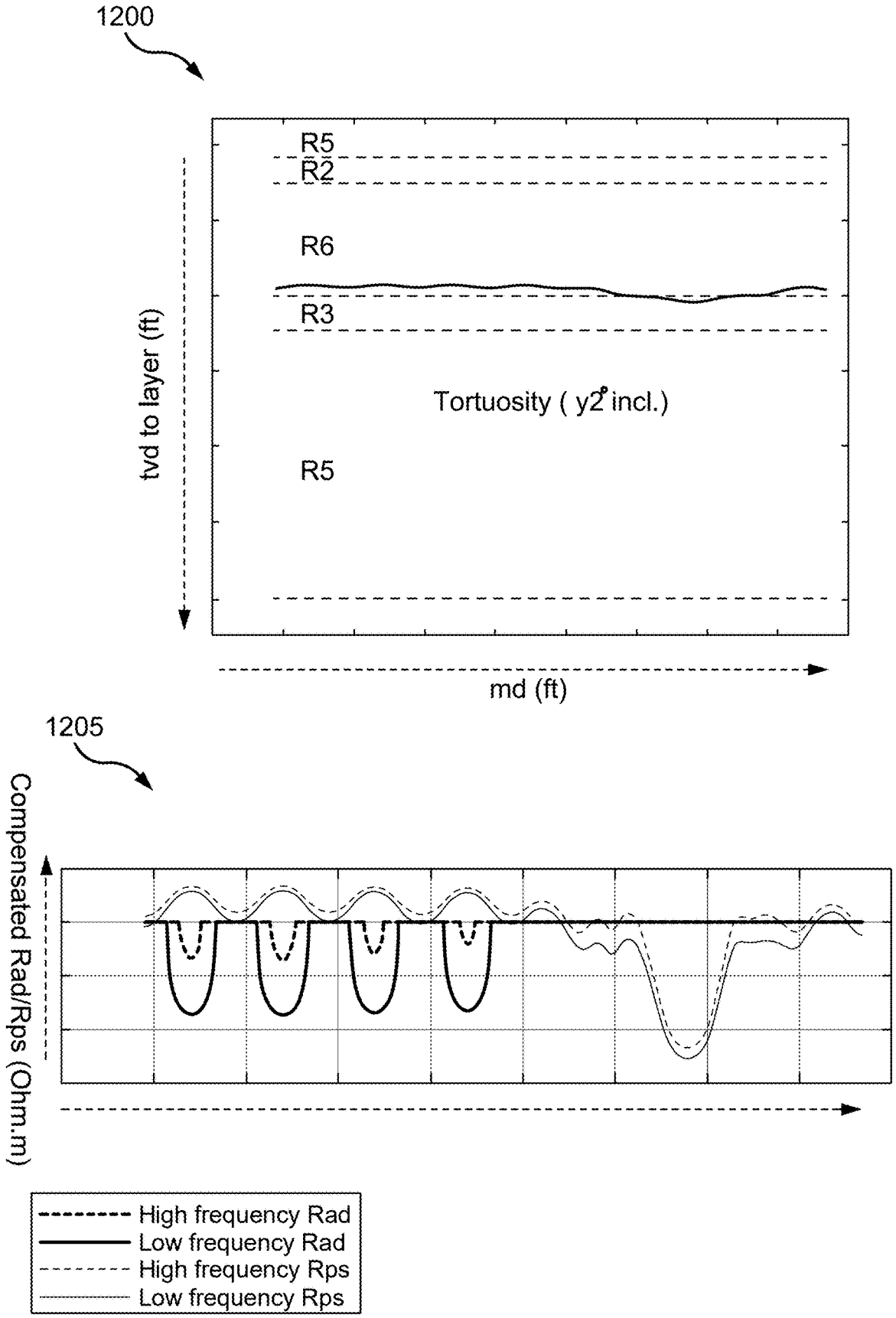
FIG. 12 illustrates example resistivity with wellbore tortuosity for a well with a second inclination.

FIG. 11 is a graph 1105 modeling example resistivity responses with tortuosity for a trajectory 1100 in a high resistivity (R6) layer having a first inclination of y1 degrees. FIG. 12 is a graph 1205 modeling example resistivity responses with tortuosity for a trajectory 1200 in the high resisitvity (R6) layer having a second inclination of y2 degrees. As shown in FIGS. 11-12, the larger the variance, the larger the magnitude of the identified anticorrelation.

Accordingly, based on a magnitude of detected anticorrelation of Rad and Rps in resistivity propagation logs, boundary approaching conditions may be detected. In some aspects, the boundary approaching conditions may be detected for a high angle or horizontal well. In some aspects, wellbore tortuosity may be determined based on the anticorrelation. In some aspects, high resistivity formation with shoulder bed contrast may be determined. In some aspects, the detection of the boundary approaching conditions and/or the identification of the anticorrelation may be used for real time geosteering.

Figure 13:
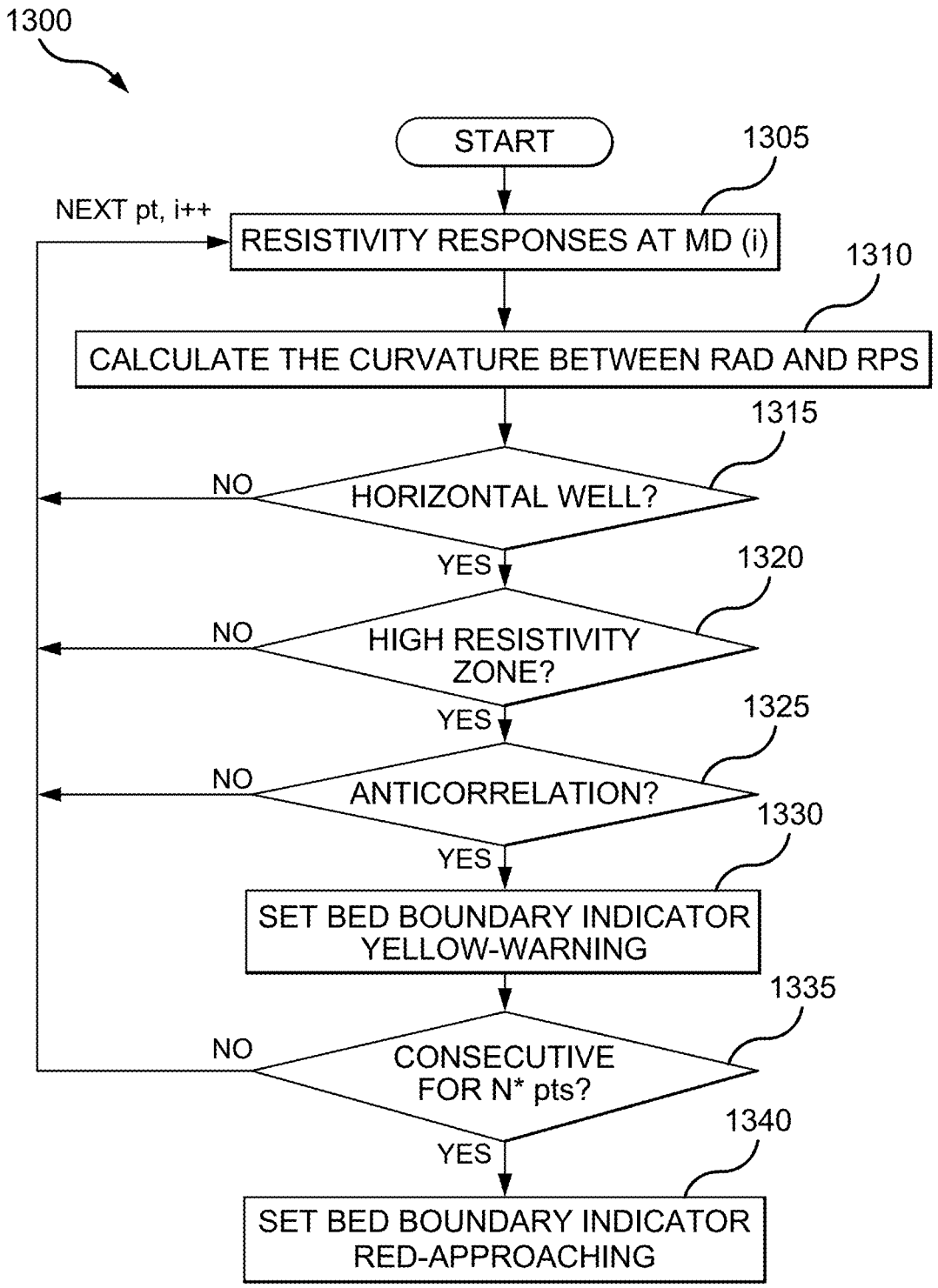
FIG. 13 is an example workflow diagram for geosteering using anticorrelation in resistivity logs

FIG. 13 depicts an example workflow 1300 for boundary approaching detection using identification of anticorrelation in resistivity propagation logs. The workflow 1300 may be implemented downhole and/or at surface. The workflow 1300 may be implemented independently for real time geosteering decision making directly. The workflow 1300 may be implemented as a quality check upon the inversions.

As shown in FIG. 13, the workflow 1300 may begin at step 1305 with collecting propagation resistivity responses at a measurement depth, MD (i). The propagation resistivity responses may include the Rad and Rps.

At step 1310, the workflow 1300 proceeds with calculating the curvature of the Rad and Rps.

If the well is not a horizontal well, or if the well is not in a horizontal portion (e.g., there is no tortuosity) at the MD point, then at step 1315 the workflow 1300 may return to the step 1305 to check a next MD point. Otherwise, the workflow 1300 may continue to step 1325.

If the MD point is not in a high resistivity zone (e.g., a zone having a resistivity above a specified threshold), then at step 1320 the workflow 1300 may return to the step 1305. Otherwise, the workflow 1300 may continue to the step 1325.

If no anticorrelation is identified between the Rad and Rps curves at step 1325, the workflow 1300 may return to the step 1305. Otherwise, the workflow 1300 may continue to the step 1330.

At step 1330, in response to identifying anticorrelation between the Rad and Rps curves, a bed boundary approaching warning indicator may be set (e.g., provided to an operator of the well). For example, a yellow warning light, a sound, or other indicator may be set.

At step 1335, the workflow 1300 includes checking for anticorrelation in a prespecified number of consecutive MD points subsequent the MD point with the identified anticorrelation. If anticorrelation is not identified in those MD points, the workflow 1300 may return to the step 1305. If anticorrelation is identified in the prespecified number of consecutive MD points, then at step 1340 a bed boundary approaching danger indicator may be set. For example, a red warning light, a sound, or other indicator may be set.

According to certain aspects, if the tortuosity of the wellbore is known or given from the available high-resolution survey, then the workflow 1300 may further include estimating the distance to bed boundary based on the tortuosity and anticorrelation. In this case, the indicators may be set based on the estimated distance or the estimated distance may be a further output to the operator. In some aspects, the distance to the bed boundary may be estimated utilizing a lookup table. For example, the look up table may include entries mapping combinations of values of the tortuosity and anticorrelation (e.g., magnitude of the anticorrelation) to distances to bed boundary. In some aspects, a machine learning model may be trained to output a distance to boundary. In this case, values of the tortuosity and anticorrelation may be input to the trained machine learning model to output a predicted distance to boundary. In some aspects, the machine learning model performs a regression analysis. In some aspects, the indicator may be a quality check on surface inversions, which could quantify the multi-layer resistivities, as well as the distance to the bed boundary, etc.

Example Operations

Figure 14:
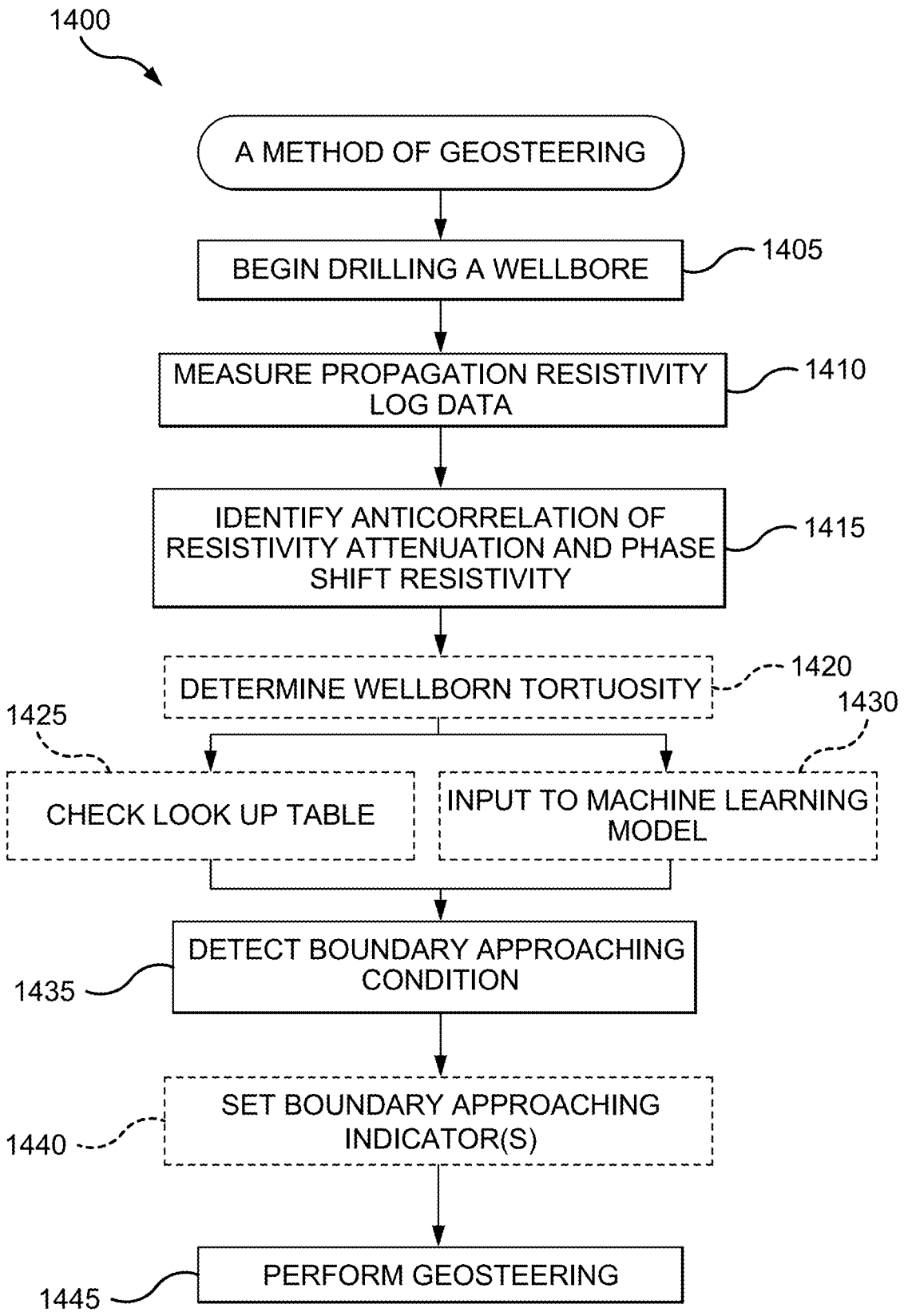
FIG. 14 is a flow diagram depicting an example method for geosteering using anticorrelation in resistivity logs.

FIG. 14 is a flow diagram depicting an example operations 1400 for geosteering based on detection of boundary approaching conditions using anticorrelation in resistivity propagation logs.

As shown, the operations 1400 may include beginning drilling a wellbore at operation 1405.

The operations 1400 may include measuring propagation resistivity log data at operation 1410.

The operations 1400 may include identifying anticorrelation of resistivity attenuation and phase shift resistivity in the propagation resistivity log data at operation 1415.

The operations 1400 may include determining wellbore tortuosity at operation 1420.

The operations 1400 may include checking a look up table (e.g., for an entry corresponding to the anticorrelation and/or tortuosity) at operation 1425 and/or inputting the anticorrelation and/or tortuosity to a machine learning model at operation 1430.

The operations 1400 may include detecting a boundary approaching condition (e.g., based on the look up table entry or the output of the machine learning model) at operation 1435.

The operations 1400 may include setting one or more boundary approaching indicators based on the detection at operation 1440.

The operations 1400 may include performing geosteering based on the detection and/or the one or more indicators at operation 1445.

Example System

Figure 15:
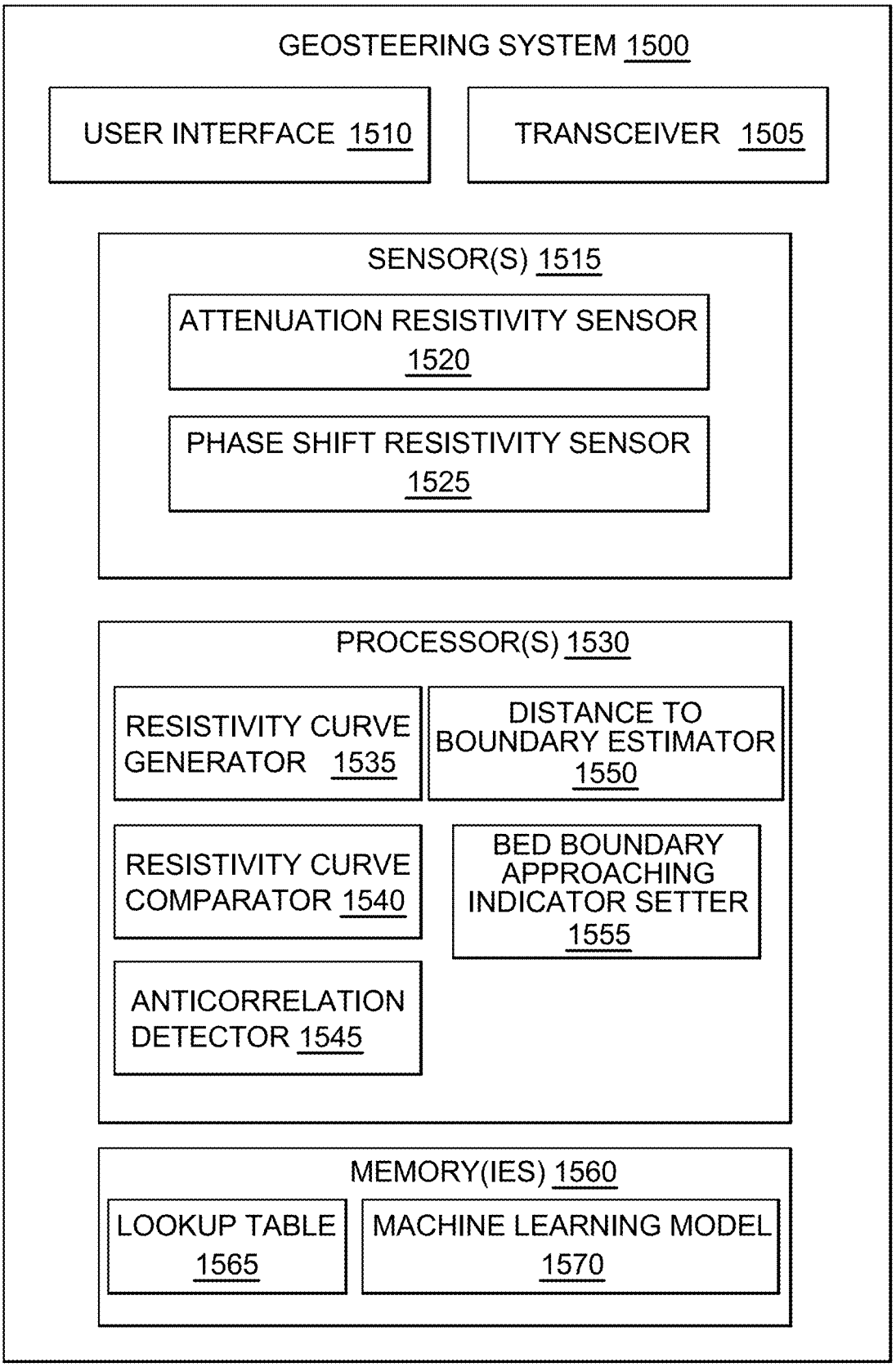
FIG. 15 is an example processing system for geosteering using anticorrelation in resistivity logs.

According to certain aspects, a geosteering system 1500 is provided for geosteering based on detection of boundary approaching conditions using anticorrelation in resistivity propagation logs, as shown in FIG. 15. The geosteering system 1500 may be located downhole, at a surface of the wellbore, may be remote, may include both local and remote components, and/or may be distributed. Accordingly, the geosteering system 1500 may run on a single computing device or across multiple devices.

As shown, the geosteering system 1500 may include one or more user interfaces 1510 on the one or more devices comprising the geosteering system 1500 that allow a user to interact with the geosteering system 1500. For example, the user interface(s) 1510 may include a graphical user interface (GUI) that display to a user and/or accepts touch screen inputs from the user. The user interface(s) 1510 may include one or more input/output (IOs) interfaces that allows one or more I/O devices (e.g., keyboards, displays, mouse devices, pen inputs, microphones, etc.) to connect to the geosteering system 1500. In some aspects, the user interface(s) 1510 are configured to output a bed boundary approaching warning indicator and/or a bed boundary approaching danger indicator as described herein.

As shown in FIG. 15, the geosteering system 1500 may include a transceiver 1505 and one or more network interface(s) 1515. The transceiver 1505 and network interface(s) 1515 may allow the geosteering system 1500 to connect to a network (e.g., such as the Internet, a local area network (LAN), a wireless LAN (WLAN), a wireless wide area network (WWAN), Wi-Fi, etc.) and/or to communicate with other devices, such as to communicatively connect devices within the geosteering system 1500 and/or devices external to the geosteering system 1500.

As shown, the geosteering system 1500 may include one or more sensor(s) 1520. In some aspects, the sensor(s) 1520 include one or more LWD and/or WMD tools. For example, the sensor(s) 1520 may include LWD propagation resistivity sensors, such as attenuation resistivity sensor(s) 1520 and phase shift resistivity sensor(s) 1525.

As shown, the geosteering system 1500 may include a processing system including one or more processor(s) 1530. The one or more processor(s) 1530 may comprise one or more central processing units (CPUs). The processing system may further include memory(ies) 1560 and/or storage (s), which may be local to the geosteering system 1500 or remote (e.g., cloud storage). The CPU may retrieve and execute programming instructions stored in the memory(ies) 1560. Similarly, the CPU may retrieve and store application data residing in the memory(ies) 1560. The CPU may have multiple processing cores. The memory 1560 may represent a random access memory (RAM). The storage may be a disk drive, a combination of fixed or removable storage devices, such as fixed disc drives, removable memory cards or optical storage, network attached storage (NAS), or a storage area-network (SAN). In some aspects, the processor(s) 1530 may include a resistivity curve generator 1535 configured to compute Rad curve from the attenuation resistivity measurement data and a Rps curve from the phase shift resistivity measurement data. In some aspects, the processor(s) 1530 may include a resistivity curve comparator 1540 configured to compare the Rps and Rad curves. In some aspects, the processor(s) 1530 may include an anticorrelation detector 1545 configured to identify anticorrelation between the Rps and Rad at one or more MD points based on the comparison of the Rps and Rad curves. In some aspects, the processor(s) 1530 may include a distance to boundary estimator 1550 configured to estimate a distance to the bed boundary based on the detected anticorrelation. In some aspects, the distance to boundary estimator 1550 estimates the distance to the bed boundary further based on a tortuosity of the well. In some aspects, the distance to boundary estimator 1550 estimates the distance using a look up table 1565 or a trained machine learning model 1570 stored in memory(ies) 1560. In some aspects, the processor(s) 1530 may include a bed boundary approaching indicator setter 1555 configured to set one or more indicators (e.g., a warning and/or a danger indicator) based on the detected anticorrelation and/or the estimated distance to bed boundary.

Example Clauses

Implementation examples are described in the following numbered aspects:

Aspect 1: A method for geosteering, the method comprising: collecting logging while drilling (LWD) measurements during drilling of a well, wherein the LWD measurements include propagation resistivity response data; determining one or more attenuation resistivity values and one or more phase shift resistivity values from the propagation resistivity response data; identifying an anticorrelation between the one or more attenuation resistivity values and the one or more phase shift resistivity values; and making a geosteering decision for the drilling of the well in response to the identified anticorrelation.

Aspect 2: The method of Aspect 1, wherein the well comprises a high angle or horizontal well.

Aspect 3: The method of any combination of Aspects 1-2, wherein the collecting of the LWD measurements comprises collecting the LWD measurements in a high resistivity section of the well, and wherein the identifying the anticorrelation comprises identifying the anticorrelation in the LWD measurements of the high resistivity section of the well.

Aspect 4: The method of any combination of Aspects 1-3, wherein making the geosteering decision is further based on at least one of: a formation resistivity, a shoulder bed resistivity, or a tortuosity of the well.

Aspect 5: The method of any combination of Aspects 1-4, further comprising determining at least one of: a bed boundary approaching condition, a distance to the bed, a resistivity of a well formation, a resistivity of a shoulder bed, one or more formation features, or a tortuosity of the well based on the identified anticorrelation.

Aspect 6: The method of Aspect 5, wherein the determining is based on a look up table mapping values of the anticorrelation to the at least one of: the bed boundary approaching condition, the distance to the bed, the resistivity of a well formation, a resistivity of a shoulder bed, the one or more formation features, or the tortuosity of the well.

Aspect 7: The method of Aspect 6, wherein the look up table mapping combination of the values of the anticorrelation with values of tortuosity of the well to the at least one of: the bed boundary approaching condition, the distance to the bed, the resistivity of a well formation, a resistivity of a shoulder bed, or the one or more formation features of the well.

Aspect 8: The method of any combination of Aspects 5-7, wherein the determining comprises: inputting at least one of: the one or more attenuation resistivity values and one or more phase shift resistivity values, one or more values of magnitude of the anticorrelation, or one or more tortuosity values of the well to trained machine learning model; and obtaining the at least one of: the bed boundary approaching condition, the distance to the bed, the resistivity of a well formation, the resistivity of a shoulder bed, the one or more formation features, or the tortuosity of the well from the trained machine learning model.

Aspect 9: The method of any combination of Aspects 1-8, wherein identifying the anticorrelation between the one or more attenuation resistivity values and the one or more phase shift resistivity values comprises: determining an attenuation resistivity curve of the one or more attenuation resistivity values as a function of measured depth; determining a phase shift resistivity curve of the one or more phase shift resistivity values as a function of the measured depth; and identifying the anticorrelation based on a relationship between the attenuation resistivity curve and the phase shift resistivity curve.

Aspect 10: The method of any combination of Aspects 1-9, further comprising determining a magnitude of the anticorrelation, wherein the making the geosteering decision is further based on the determined magnitude of the anticorrelation.

Aspect 11: The method of Aspect 10, wherein the making the geosteering decision is further based on the determined magnitude of the anticorrelation comprises making the geosteering decision in response to the magnitude of the anticorrelation satisfying one or more thresholds.

Aspect 12: The method of any combination of Aspects 1-11, wherein the making the geosteering decision for the drilling of the well comprises outputting an indicator to an operator indicting a boundary approaching condition.

Aspect 13: The method of Aspect 12, wherein outputting the indicator comprises: outputting a first boundary approaching warning indicator in response an initial identification of the anticorrelation; and outputting a second boundary approaching danger indicator in response to one or more subsequent identifications of the anticorrelation, wherein the second boundary approaching danger indicator indicates a higher warning level than the first boundary approaching warning indicator.

Aspect 14: The method of any combination of Aspects 1-13, wherein the making the geosteering decision for the drilling of the well comprises changing a drilling trajectory of the well.

Aspect 15: A system for performing the geosteering of any combination of Aspects 1-14.

Aspect 16: An apparatus for performing the geosteering of any combination of Aspects 1-14.

Aspect 17: A non-transitory computer readable medium for performing the geosteering of any combination of Aspects 1-14.

Additional Considerations

The preceding description is provided to enable any person skilled in the art to practice the various aspects described herein. The examples discussed herein are not limiting of the scope, applicability, or aspects set forth in the claims. Various modifications to these aspects will be readily apparent to those skilled in the art, and the general principles defined herein may be applied to other aspects. For example, changes may be made in the function and arrangement of elements discussed without departing from the scope of the disclosure. Various examples may omit, substitute, or add various procedures or components as appropriate. For instance, the methods described may be performed in an order different from that described, and various actions may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein may be embodied by one or more elements of a claim.

The various illustrative logical blocks, modules and circuits described in connection with the present disclosure may be implemented or performed with a general purpose processor, a digital signal processor (DSP), an ASIC, a field programmable gate array (FPGA) or other programmable logic device (PLD), discrete gate or transistor logic, discrete hardware components, or any combination thereof designed to perform the functions described herein. A general-purpose processor may be a microprocessor, but in the alternative, the processor may be any commercially available processor, controller, microcontroller, or state machine. A processor may also be implemented as a combination of computing devices, e.g., a combination of a DSP and a microprocessor, a plurality of microprocessors, one or more microprocessors in conjunction with a DSP core, a system on a chip (SoC), or any other such configuration.

As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

As used herein, the term "determining" encompasses a wide variety of actions. For example, "determining" may include calculating, computing, processing, deriving, investigating, looking up (e.g., looking up in a table, a database or another data structure), ascertaining and the like. Also, "determining" may include receiving (e.g., receiving information), accessing (e.g., accessing data in a memory) and the like. Also, "determining" may include resolving, selecting, choosing, establishing and the like.

The methods disclosed herein comprise one or more actions for achieving the methods. The method actions may be interchanged with one another without departing from the scope of the claims. In other words, unless a specific order of actions is specified, the order and/or use of specific actions may be modified without departing from the scope of the claims. Further, the various operations of methods described above may be performed by any suitable means capable of performing the corresponding functions. The means may include various hardware and/or software component(s) and/or module(s), including, but not limited to a circuit, an application specific integrated circuit (ASIC), or processor.

The following claims are not intended to be limited to the aspects shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S.C. § 112(f) unless the element is expressly recited using the phrase "means for". All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

The invention claimed is:

1. A method for geosteering, the method comprising:

collecting logging while drilling (LWD) measurements during drilling of a well, wherein the LWD measurements include propagation resistivity response data;

determining one or more attenuation resistivity values and one or more phase shift resistivity values from the propagation resistivity response data;

identifying an anticorrelation between the one or more attenuation resistivity values and the one or more phase shift resistivity values; and making a geosteering decision for the drilling of the well in response to the identified anticorrelation.

2. The method of claim 1, wherein the well comprises a high angle or horizontal well.

3. The method of claim 1, wherein the collecting of the LWD measurements comprises collecting the LWD measurements in a high resistivity section of the well, and wherein the identifying the anticorrelation comprises identifying the anticorrelation in the LWD measurements of the high resistivity section of the well.

4. The method of claim 1, wherein making the geosteering decision is further based on at least one of: a formation resistivity, a shoulder bed resistivity, or a tortuosity of the well.

5. The method of claim 1, further comprising determining at least one of: a bed boundary approaching condition, a distance to the bed, a resistivity of a well formation, a resistivity of a shoulder bed, one or more formation features, or a tortuosity of the well based on the identified anticorrelation.

6. The method of claim 5, wherein the determining the at least one of: the bed boundary approaching condition, the distance to the bed, the resistivity of a well formation, the resistivity of a shoulder bed, the one or more formation features, or the tortuosity of the well is based on a look up table mapping values of the anticorrelation to the at least one of: the bed boundary approaching condition, the distance to the bed, the resistivity of a well formation, the resistivity of a shoulder bed, the one or more formation features, or the tortuosity of the well.

7. The method of claim 6, wherein the look up table maps a combination of the values of the anticorrelation with values of tortuosity of the well to the at least one of: the bed boundary approaching condition, the distance to the bed, the resistivity of a well formation, the resistivity of a shoulder bed, or the one or more formation features of the well.

8. The method of claim 5, wherein the determining the at least one of: the bed boundary approaching condition, the distance to the bed, the resistivity of a well formation, the resistivity of a shoulder bed, the one or more formation features, or the tortuosity of the well comprises:

inputting at least one of: the one or more attenuation resistivity values and the one or more phase shift resistivity values, one or more values of magnitude of the anticorrelation, or one or more tortuosity values of the well to a trained machine learning model; and obtaining the at least one of: the bed boundary approaching condition, the distance to the bed, the resistivity of a well formation, the resistivity of a shoulder bed, the one or more formation features, or the tortuosity of the well from the trained machine learning model.

9. The method of claim 1, wherein identifying the anticorrelation between the one or more attenuation resistivity values and the one or more phase shift resistivity values comprises:

determining an attenuation resistivity curve of the one or more attenuation resistivity values as a function of measured depth;

determining a phase shift resistivity curve of the one or more phase shift resistivity values as a function of the measured depth; and identifying the anticorrelation based on a relationship between the attenuation resistivity curve and the phase shift resistivity curve.

10. The method of claim 1, further comprising determining a magnitude of the anticorrelation, wherein the making the geosteering decision is further based on the determined magnitude of the anticorrelation.

11. The method of claim 10, wherein making the geosteering decision based on the determined magnitude of the anticorrelation comprises making the geosteering decision in response to the magnitude of the anticorrelation satisfying one or more thresholds.

12. The method of claim 1, wherein the making the geosteering decision for the drilling of the well comprises outputting an indicator to an operator indicating a boundary approaching condition.

13. The method of claim 12, wherein outputting the indicator comprises:

outputting a first boundary approaching warning indicator in response to an initial identification of the anticorrelation; and outputting a second boundary approaching danger indicator in response to one or more subsequent identifications of the anticorrelation, wherein the second boundary approaching danger indicator indicates a higher warning level than the first boundary approaching warning indicator.

14. The method of claim 1, wherein the making the geosteering decision for the drilling of the well comprises changing a drilling trajectory of the well.

15. A system comprising:

one or more logging while drilling (LWD) tools configured to collect LWD measurements during drilling of a well, wherein the LWD measurements include propagation resistivity response data; and one or more processors configured to:

determine one or more attenuation resistivity values and one or more phase shift resistivity values from the propagation resistivity response data;

identify an anticorrelation between the one or more attenuation resistivity values and the one or more phase shift resistivity values; and make a geosteering decision for the drilling of the well in response to the identified anticorrelation.

16. The system of claim 15, wherein the collecting of the LWD measurements comprises collecting the LWD measurements in a high resistivity section of the well, and wherein the identifying the anticorrelation comprises identifying the anticorrelation in the LWD measurements of the high resistivity section of the well.

17. The system of claim 15, wherein making the geosteering decision is further based on at least one of: a formation resistivity, a shoulder bed resistivity, or a tortuosity of the well.

18. The system of claim 15, wherein the one or more processors are further configured to determine at least one of: a bed boundary approaching condition, a distance to the bed, a resistivity of a well formation, a resistivity of a shoulder bed, one or more formation features, or a tortuosity of the well based on the identified anticorrelation.

19. The system of claim 18, further comprising memory configured to store a look up table mapping values of the anticorrelation to the at least one of: the bed boundary approaching condition, the distance to the bed, the resistivity of a well formation, the resistivity of a shoulder bed, the one or more formation features, or the tortuosity of the well, wherein the determining the at least one of: the bed boundary approaching condition, the distance to the bed, the resistivity of a well formation, the resistivity of a shoulder bed, the one or more formation features, or the tortuosity of the well is based on the look up table.

20. A non-transitory computer readable medium storing computer executable code for geosteering, the computer executable code comprising:

code for collecting logging while drilling (LWD) measurements during drilling of a well, wherein the LWD measurements include propagation resistivity response data;

code for determining one or more attenuation resistivity values and one or more phase shift resistivity values from the propagation resistivity response data;

code for identifying an anticorrelation between the one or more attenuation resistivity values and the one or more phase shift resistivity values; and code for making a geosteering decision for the drilling of the well in response to the identified anticorrelation.

* * * * *